US008398361B2

(12) United States Patent
Sagoo et al.

(10) Patent No.: US 8,398,361 B2
(45) Date of Patent: Mar. 19, 2013

(54) HIGH-EFFICIENCY, MULTI-STAGE CENTRIFUGAL PUMP AND METHOD OF ASSEMBLY

(75) Inventors: Manjit Sagoo, Overland Park, KS (US); Arnold Sdano, Overland Park, KS (US)

(73) Assignee: Pentair Pump Group, Inc., Golden Valley, MN (US)

( * ) Notice: Subject to any disclaimer, the term of this patent is extended or adjusted under 35 U.S.C. 154(b) by 529 days.

(21) Appl. No.: 12/557,310

(22) Filed: Sep. 10, 2009

(65) Prior Publication Data

US 2010/0119363 A1 May 13, 2010

Related U.S. Application Data

(60) Provisional application No. 61/095,863, filed on Sep. 10, 2008.

(51) Int. Cl.
*F04D 17/12* (2006.01)
*F04D 13/12* (2006.01)

(52) U.S. Cl. ..... 415/66; 415/206; 415/67; 415/68; 416/198 R

(58) Field of Classification Search ..... 415/66, 415/68, 206, 199.2; 417/244, 3
See application file for complete search history.

(56) References Cited

U.S. PATENT DOCUMENTS 681,581 A * 8/1901 Richards ..... 415/104
1,130,422 A * 3/1915 Mueller ..... 415/199.2
2,753,807 A * 7/1956 Lung ..... 415/199.2
2,844,100 A * 7/1958 Heinicke ..... 417/423.14
4,177,008 A 12/1979 Florjancic
5,114,311 A 5/1992 Becker et al.
5,219,271 A 6/1993 Nachtrieb
5,456,577 A 10/1995 O'Sullivan et al.
5,478,200 A 12/1995 Brodersen et al.
5,522,701 A 6/1996 Nicklas et al.
5,531,456 A 7/1996 Riel
5,545,008 A 8/1996 Guelich
5,551,837 A 9/1996 Hergt
5,626,460 A 5/1997 Franke et al.
5,634,769 A 6/1997 Metzinger
5,755,554 A 5/1998 Ryall
5,779,445 A 7/1998 Yokota et al.
5,785,495 A 7/1998 Springer et al.
5,795,129 A 8/1998 Urban et al.
5,846,055 A 12/1998 Brodersen et al.
5,984,629 A 11/1999 Brodersen et al.
6,017,187 A 1/2000 Mueller
6,019,927 A * 2/2000 Galliger ..... 264/221
6,053,698 A 4/2000 Hergt et al.
6,139,260 A 10/2000 Arbeus (Continued)

OTHER PUBLICATIONS

A.J. Stepanoff, Ph.D; Centrifugal and Axial Flow Pumps Theory, Design, and Application; 1948; pp. 132-143; Figures 34 and 78; John Wiley & Sons, Inc., London; Chapman & Hall, Limited.

(Continued)

*Primary Examiner* — Ninh H Nguyen
*Assistant Examiner* — William Grigos
(74) *Attorney, Agent, or Firm* — Quarles & Brady LLP

(57) ABSTRACT

A high-efficiency, multi-stage centrifugal pump and method of assembly. The pump can include three pump stages with each one of the three pump stages including a front casing, a back casing, an impeller, and a bladed diffuser. The front casing and the back casing are removeably coupled around the impeller and the bladed diffuser. In the three-stage pump, the fluid can be pumped at a flow rate between about 300 liters per second and about 500 liters per second with an efficiency between about 86% and about 91%. The method includes separately casting, machining, and polishing each one of the front casing, the back casing, the impeller, and the bladed diffuser.

8 Claims, 24 Drawing Sheets

U.S. PATENT DOCUMENTS

| | | | |
|---|---|---|---|
| 6,158,959 | A | 12/2000 | Arbeus |
| 6,273,677 | B1 | 8/2001 | Wang et al. |
| 6,315,453 | B1 | 11/2001 | Leibundgut |
| 6,406,277 | B1 | 6/2002 | Shafer et al. |
| 6,439,835 | B1 | 8/2002 | Chien et al. |
| 6,442,838 | B1 | 9/2002 | Mussler |
| 6,471,468 | B1 | 10/2002 | Hartmann |
| 6,536,271 | B1 | 3/2003 | Gopalakrishnan et al. |
| 6,551,054 | B1 | 4/2003 | Peltonen et al. |
| 6,568,901 | B2 | 5/2003 | Wang et al. |
| 6,609,890 | B2 | 8/2003 | Budris et al. |
| 7,037,086 | B2 | 5/2006 | Irvine |
| 7,198,457 | B2 | 4/2007 | Chiba et al. |
| 7,290,984 | B2 | 11/2007 | Volk |
| 7,306,427 | B2 | 12/2007 | Ahlroth et al. |
| 7,318,707 | B2 | 1/2008 | Scharffenberger |
| 7,326,029 | B2 | 2/2008 | Ahlroth et al. |
| 7,338,252 | B2 | 3/2008 | Meuter |
| 7,377,744 | B2 | 5/2008 | Urban et al. |
| 7,435,277 | B2 | 10/2008 | Raussi et al. |
| 2005/0074331 | A1* | 4/2005 | Watson ..... 415/199.2 |
| 2005/0179208 | A1 | 8/2005 | Meuter |
| 2005/0191192 | A1 | 9/2005 | Heng et al. |
| 2005/0244091 | A1 | 11/2005 | Bross et al. |
| 2005/0265866 | A1 | 12/2005 | Bross et al. |
| 2006/0127232 | A1 | 6/2006 | Urban et al. |
| 2006/0248963 | A1 | 11/2006 | Gulich |
| 2007/0160467 | A1 | 7/2007 | Lienau et al. |
| 2007/0183892 | A1* | 8/2007 | Sorokes ..... 415/214.1 |
| 2008/0019831 | A1 | 1/2008 | Kajiwara et al. |
| 2008/0056846 | A1 | 3/2008 | Ahlroth et al. |
| 2008/0213093 | A1 | 9/2008 | Guelich |
| 2009/0116960 | A1 | 5/2009 | Lehtonen et al. |

OTHER PUBLICATIONS

Hydraulic Institute; American National Standard for Centrifugal Pumps for Nomenclature, Definitions, Application and Operation; May 23, 1994; pp. 18, 19, 20; Parsippany, New Jersey, USA.

* cited by examiner

FIG. 24

PERFORMANCE TEST, PUMP DATA

| DESIGN POINT | | | |
|---|---|---|---|
| 6340 | | | GPM |
| 977.7 | | | FEET |
| 1489 | | | RPM |
| 89 | | | % EFF |

DRIVER: 1500 HP FM TEST MOTOR
VENTURI: 12x8.245 K=1489.4 EFFR= 1.005
DIFF SN: 715520

IMPELLER: T7TB92B
IMP DIA: 22.25 STRAIGHT
IMP LAND: 0.19 SEMI_STREAMLINED
SUCTION SN: "hg
DISCH SN: 2024774 500 PSID
BAROMETRIC: 29.46 IN HG IMPEL LIFT=0.20"

GAUGE CORR: 4.00
SUCT ID: 28.00
DISCH ID: 15.50
LIQUID: WATER
TEMP: 71.5
SG: 1.000
N=1489 RPM

| INPUT DATA | | | | | | | | | | CALCULATED VALUES AT TEST SPEED | | | | | | | | | FULL SPEED=1489 CORRECTED | | | |
|---|---|---|---|---|---|---|---|---|---|---|---|---|---|---|---|---|---|---|---|---|---|---|
| DISCH FEET | SUC LIFT FEET | WATER TEMP DEG. F | VENTURI DELTA P FT $H_2O$ | VOLTS | AMPS | KW | PF | SPEED RPM | VLT STR GA | TORQUE | DEL $H_{vel}$ FEET | NPSHA FEET | $H_{friction}$ FEET | FLOW RATE GPM | TOTAL HEAD FEET | BHP (STR-GA) | BHP ELC | PUMP EFF % | FLOW RATE GPM | TOTAL HEAD FEET | BHP | PUMP EFF % |
| 743.3 | | | 0.00 | 4163 | 81.0 | 419.0 | 72.2% | 1196.0 | 3480.0 | 28416 | 0.0 | 36.6 | 0.0 | 0 | 747.3 | 539 | 539 | 0.0 | 0 | 1165 | 1041 | 0.0 |
| 703.5 | | | 1.10 | 4189 | 90.9 | 507.0 | 77.2% | 1195.0 | 4225.0 | 34208 | 0.1 | 36.5 | 0.0 | 1562 | 707.6 | 649 | 653 | 43.0 | 1946 | 1105 | 1255 | 43.3 |
| 705.0 | | | 2.06 | 4151 | 95.8 | 549.0 | 79.5% | 1194.0 | 4450.0 | 35964 | 0.2 | 36.4 | 0.1 | 2138 | 709.3 | 681 | 707 | 56.2 | 2666 | 1109 | 1321 | 56.5 |
| 699.6 | | | 3.84 | 4151 | 100.6 | 584.0 | 81.0% | 1194.0 | 4800.0 | 38709 | 0.4 | 36.2 | 0.1 | 2919 | 704.1 | 733 | 752 | 70.8 | 3640 | 1101 | 1422 | 71.1 |
| 687.4 | | | 6.19 | 4150 | 106.9 | 635.0 | 82.8% | 1193.0 | 5280.0 | 42514 | 0.6 | 36.0 | 0.2 | 3706 | 692.2 | 805 | 818 | 80.5 | 4625 | 1084 | 1565 | 80.9 |
| 672.5 | | | 7.21 | 4152 | 111.6 | 665.0 | 83.6% | 1194.0 | 5550.0 | 44680 | 0.7 | 35.9 | 0.2 | 3999 | 677.5 | 846 | 856 | 80.8 | 4987 | 1059 | 1642 | 81.3 |
| 655.0 | | | 8.71 | 4147 | 113.7 | 689.0 | 84.2% | 1193.0 | 5720.0 | 46056 | 0.9 | 35.7 | 0.3 | 4396 | 660.2 | 872 | 887 | 84.1 | 5486 | 1034 | 1695 | 84.5 |
| 650.0 | | | 9.76 | 4140 | 114.8 | 696.0 | 84.6% | 1194.0 | 5795.0 | 46667 | 1.0 | 35.6 | 0.3 | 4653 | 655.3 | 884 | 896 | 87.1 | 5803 | 1025 | 1715 | 87.6 |
| 626.8 | | | 11.81 | 4139 | 118.3 | 722.0 | 85.2% | 1193.0 | 6010.0 | 48428 | 1.2 | 35.4 | 0.4 | 5118 | 632.4 | 917 | 930 | 89.2 | 6388 | 990 | 1782 | 89.6 |
| 616.1 | | | 12.74 | 4139 | 119.4 | 731.0 | 85.4% | 1192.0 | 6080.0 | 49006 | 1.3 | 35.3 | 0.4 | 5316 | 621.8 | 927 | 941 | 90.1 | 6641 | 975 | 1807 | 90.5 |
| 600.7 | | | 14.08 | 4139 | 120.8 | 742.0 | 85.7% | 1194.0 | 6185.0 | 49876 | 1.4 | 35..2 | 0.5 | 5589 | 606.6 | 945 | 955 | 90.6 | 6970 | 948 | 1833 | 91.1 |
| 582.1 | | | 15.60 | 4140 | 122.8 | 757.0 | 86.0% | 1193.0 | 6320.0 | 51001 | 1.6 | 35.0 | 0.5 | 5883 | 588.2 | 965 | 975 | 90.5 | 7342 | 921 | 1877 | 91.0 |
| 562.5 | | | 17.27 | 4149 | 124.7 | 772.0 | 86.2% | 1193.0 | 6444.0 | 52043 | 1.7 | 34.9 | 0.6 | 6190 | 568.8 | 985 | 994 | 90.2 | 7725 | 891 | 1915 | 90.7 |
| 528.1 | | | 19.85 | 4143 | 127.6 | 792.0 | 86.4% | 1193.0 | 6611.0 | 53457 | 2.0 | 34.6 | 0.7 | 6636 | 534.7 | 1012 | 1020 | 88.6 | 8282 | 837 | 1967 | 89.0 |
| 502.3 | | | 21.58 | 4141 | 129.0 | 802.0 | 86.6% | 1193.0 | 6701.0 | 54225 | 2.1 | 34.4 | 0.7 | 6919 | 509.2 | 1026 | 1033 | 86.7 | 8636 | 797 | 1996 | 87.1 |
| 473.1 | | | 23.40 | 4137 | 130.2 | 811.0 | 86.9% | 1192.0 | 6775.0 | 54860 | 2.3 | 34.3 | 0.8 | 7205 | 480.2 | 1038 | 1044 | 84.2 | 9000 | 753 | 2022 | 84.7 |

| | Rs | RPM | EFF. | BHP |
|---|---|---|---|---|
| 5X3-4.30 | 0.19 | 8250 | 73.0 | 195 |
| 5X4-5.06 | 0.22 | 7000 | 75.0 | 266 |
| 6X4-5.91 | 0.26 | 6000 | 77.0 | 366 |
| 7X5-6.99 | 0.31 | 5000 | 80.0 | 490 |
| 9X6-8.16 | 0.36 | 4325 | 80.5 | 688 |
| 10X7-9.65 | 0.42 | 3600 | 81.5 | 915 |
| 12X8-11.28 | 0.50 | 3100 | 83.0 | 1273 |

HIGH-EFFICIENCY, MULTI-STAGE CENTRIFUGAL PUMP AND METHOD OF ASSEMBLY

RELATED APPLICATIONS

This application claims priority under 35 U.S.C. §119 to U.S. Provisional Patent Application No. 61/095,863 filed on Sep. 10, 2008, the entire contents of which is incorporated herein by reference.

BACKGROUND

High volume and high flow rate pump casing designs have traditionally required several compromises. While larger casings can provide greater pump efficiencies, smaller casings are often used to reduce costs. Additionally, single-piece pump casings have often included cast internal portions which are very difficult to access. These pump casings have been shaped to balance competing considerations of casting ease, cost minimization, size constraints and flow efficiency. In high volume and high flow rate applications such as sea water reverse osmosis (SWRO) applications, increasing a few percentage points in efficiency can drastically decrease energy costs.

SUMMARY

Some embodiments of the invention provide a multi-stage pump for pumping a fluid and being driven by a motor. The multi-stage pump can include three pump stages with each one of the three pump stages including a front casing, a back casing, an impeller, and a bladed diffuser. The front casing and the back casing are removeably coupled around the impeller and the bladed diffuser. The fluid can be pumped through the three pump stages at a flow rate between about 300 liters per second and about 500 liters per second with an efficiency between about 86% and about 91%.

Some embodiments of the invention provide a method for assembling a stage of a multi-stage pump. The method includes separately casting a front casing, a back casing, an impeller, and a bladed diffuser and machining the front casing, the back casing, the impeller, and the bladed diffuser. The method includes polishing a first inner surface of the front casing, polishing a second inner surface of the back casing, polishing the impeller, and polishing the bladed diffuser. The method also includes removeably coupling the front casing and the back casing together around the impeller and the bladed diffuser.

DESCRIPTION OF THE DRAWINGS

FIG. 24 is a table of test data for one embodiment of the pump.

DETAILED DESCRIPTION

Figure 1:
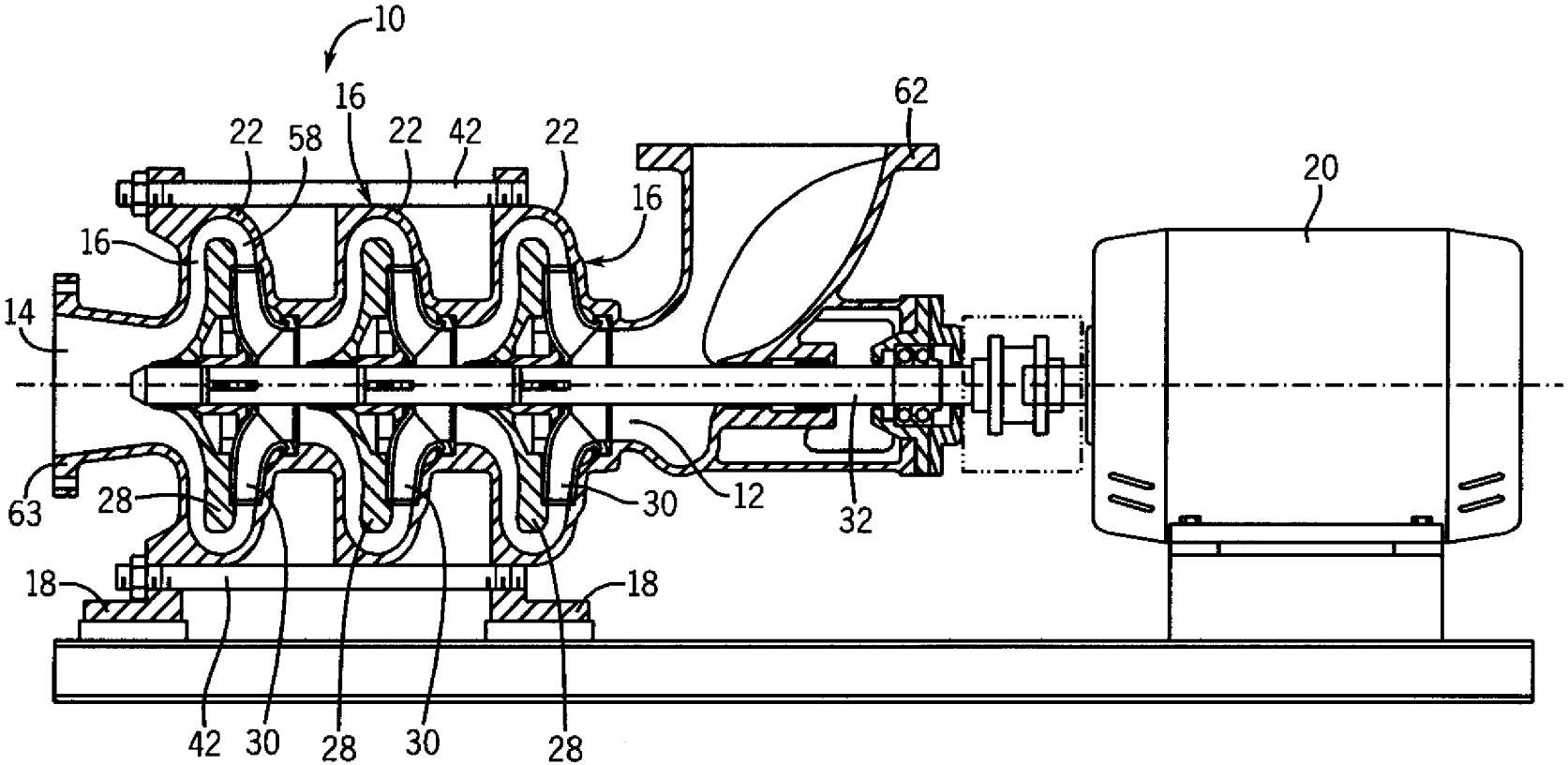
FIG. 1 is a cross-sectional view of a three-stage pump according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

FIG. 1 illustrates a multi-stage centrifugal pump 10 according to one embodiment of the invention. The pump 10 can include an inlet 12, an outlet 14, pump stages 16, and a base 18. The pump 10 can be connected to a motor 20.

In some embodiments, the pump 10 can be used for pumping fluids such as brackish water, sea water, and/or drinking water. In one example, the pump 10 can be used in a sea water reverse osmosis (SWRO) application. In brackish water applications, the pump 10 can be manufactured from stainless steel (e.g., grade 316). In sea water applications, the pump 10 can be manufactured from duplex stainless steel. In drinking water applications, the pump 10 can be manufactured from ductile iron and can be coated with a coating compliant with National Sanitation Foundation (NSF) drinking water standards. Other suitable materials can also be used for brackish water, sea water, and/or drinking water applications. Also, the pump 10 can be used in a vertical or horizontal orientation and, in some embodiments, can be used in a suction can or other pumping vessel (not shown). In some embodiments, the pump 10 can be a split case pump or a barrel pump.

Figure 2:
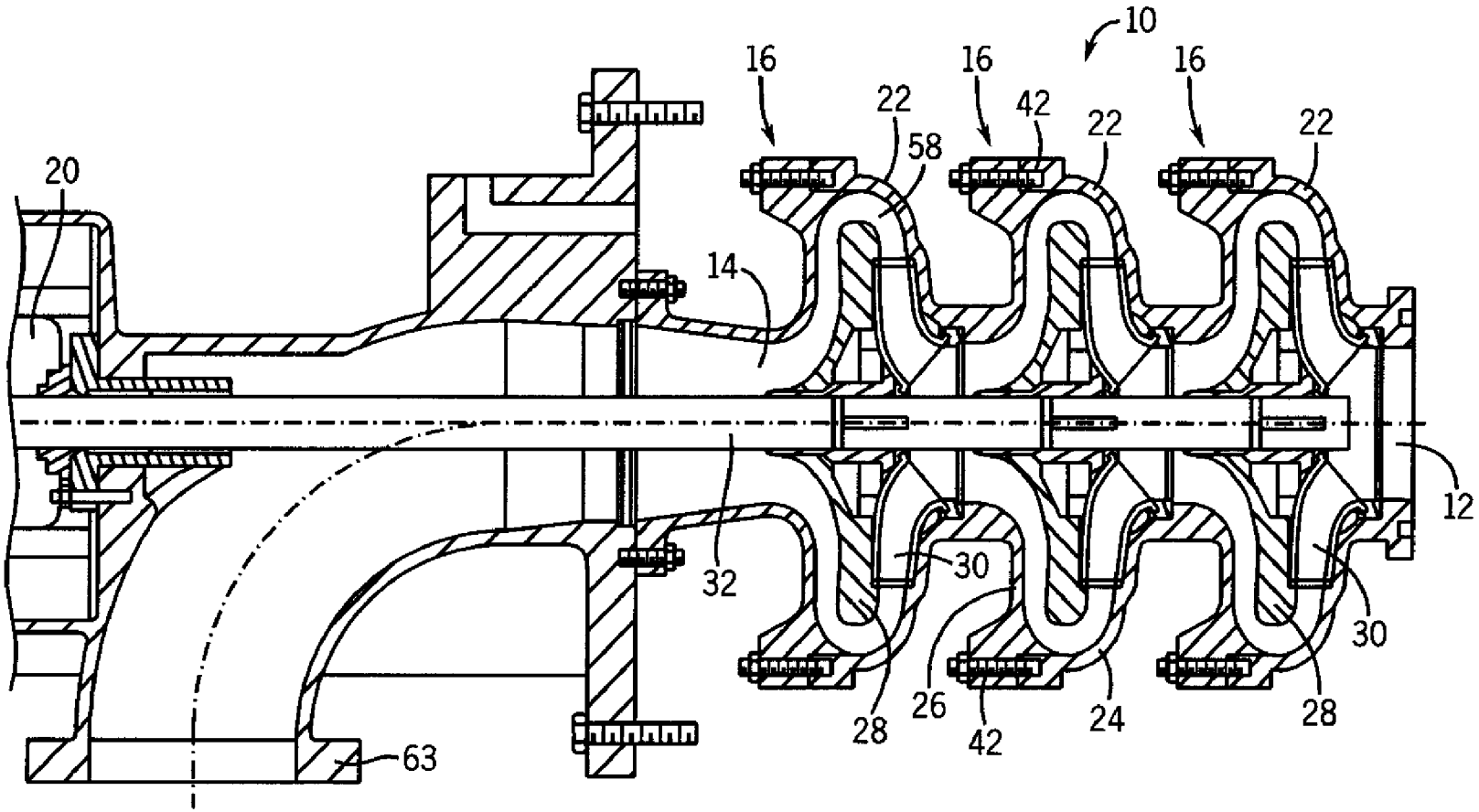
FIG. 2 is a cross-sectional view of a three-stage pump according to another embodiment of the invention.

As shown in FIGS. 1 and 2, in some embodiments, the pump 10 can be driven at a suction end (i.e., adjacent to the inlet 12), as opposed to conventional pumps that are driven at a discharge end (i.e., adjacent to the outlet 14). With this suction-end configuration, rotating shaft seals can be located at the low-pressure suction end of the pump 10 rather than at the high-pressure discharge end, and one or more static seals can be located at the high-pressure discharge end. The seal placement at the low-pressure suction end can increase reliability over conventional designs that require high-pressure shaft seals to prevent leakage. In other embodiments, however, the pump 10 can be driven at the discharge end, as shown in FIG. 2.

Figure 4:
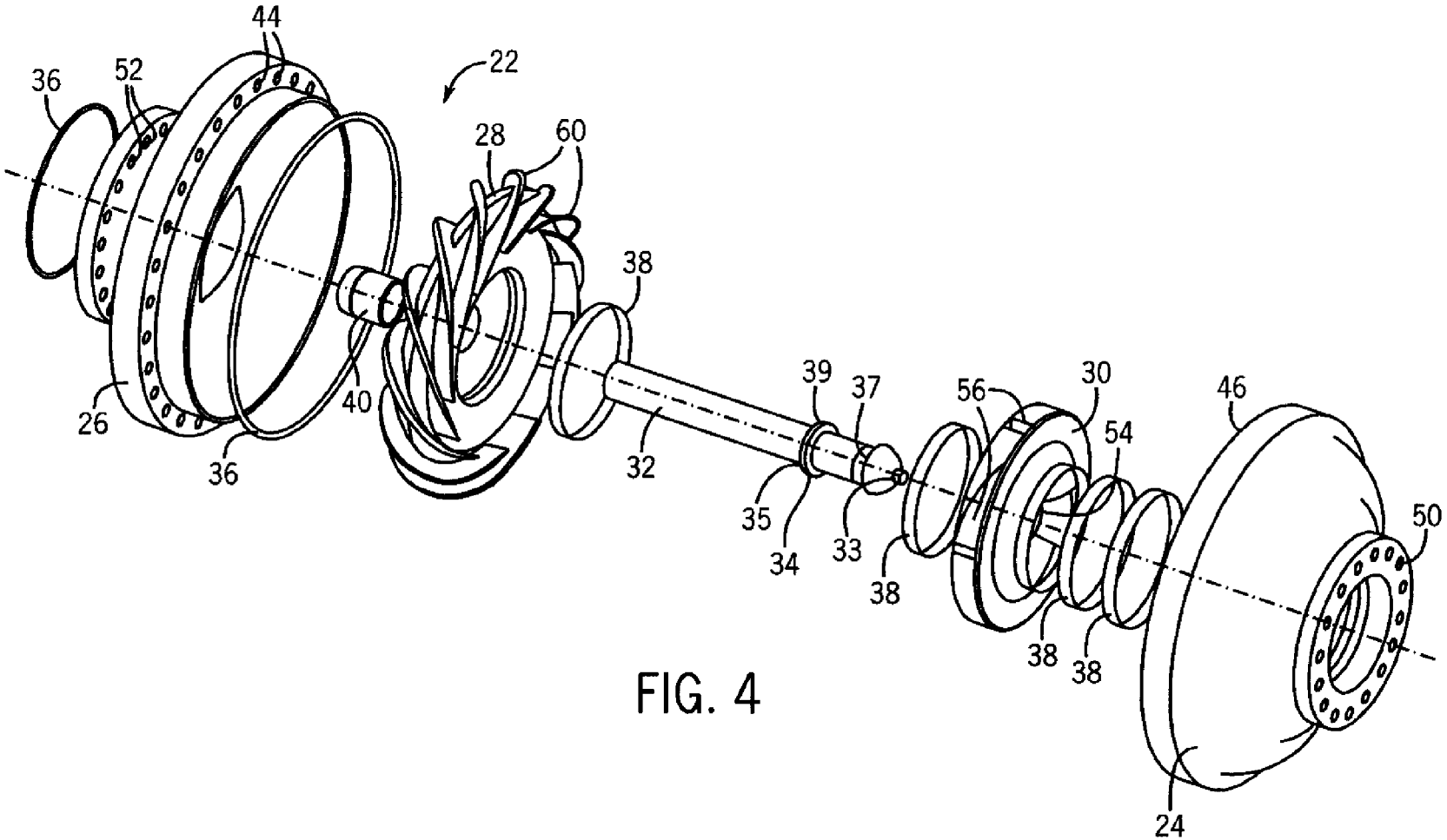
FIG. 4 is an exploded perspective view of a single-stage pump casing according to one embodiment of the invention.
Figure 5A:
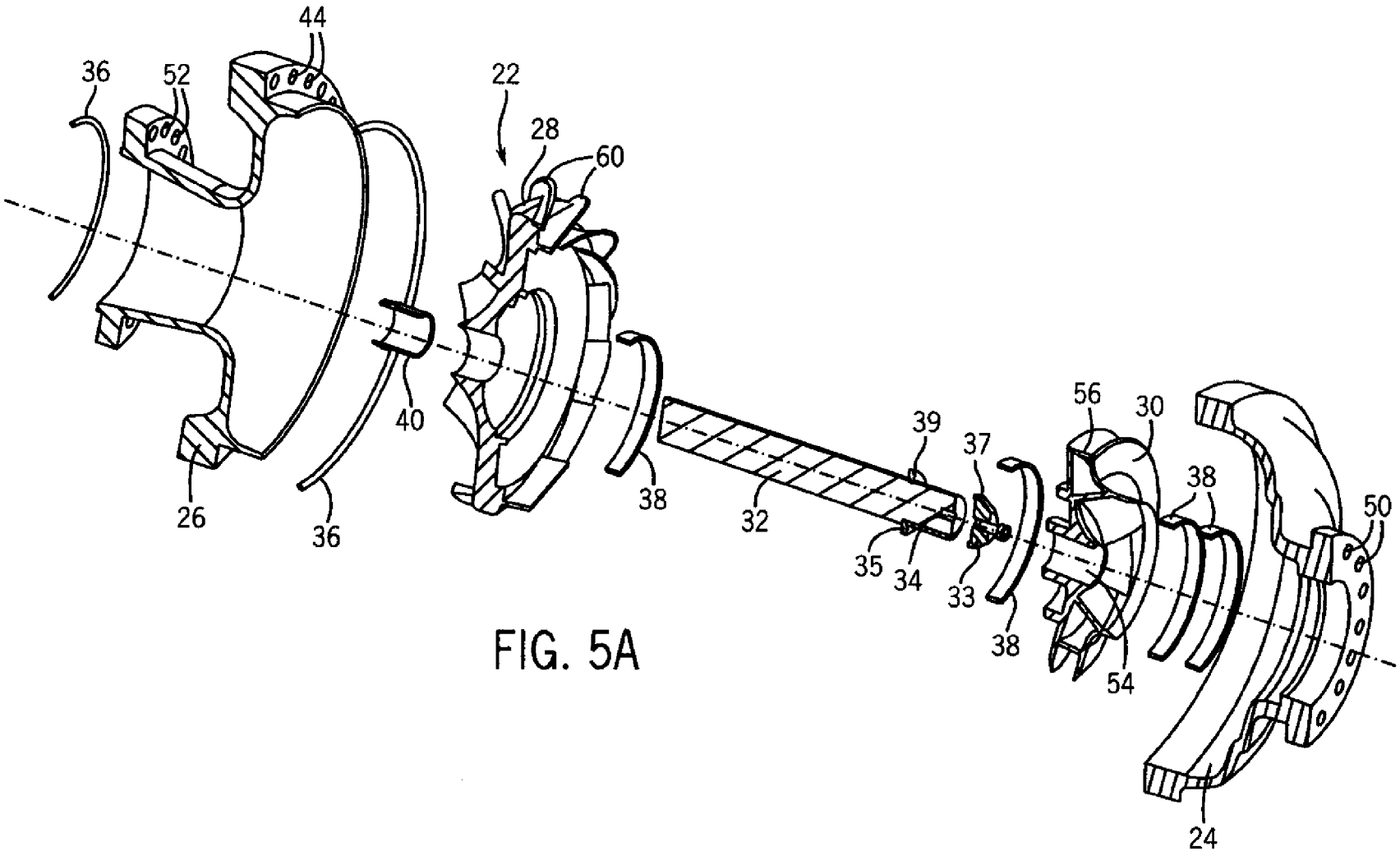
FIG. 5A is a cross-sectional exploded perspective view of the single-stage pump casing of FIG. 4.
Figure 5B:
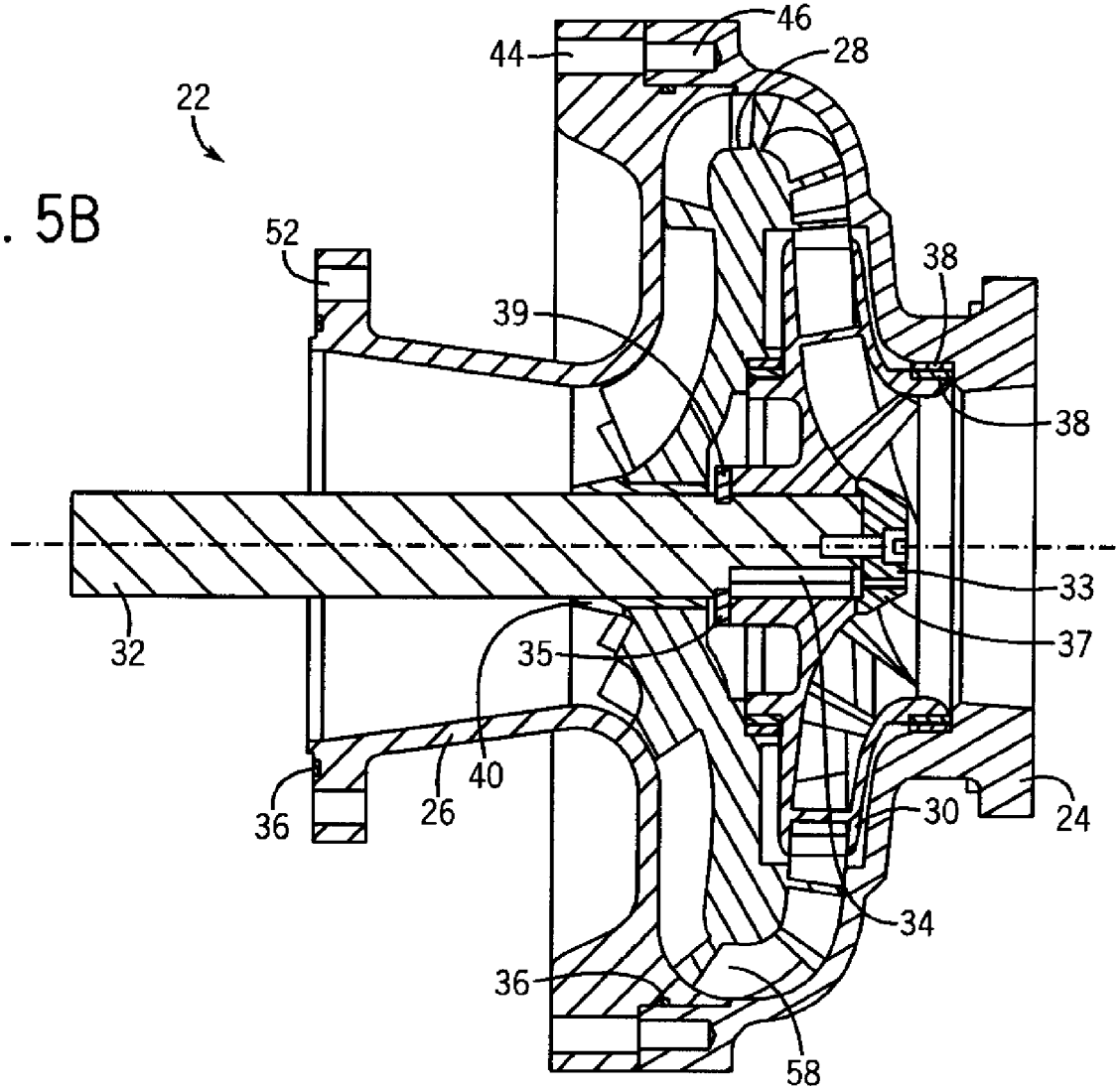
FIG. 5B is a cross-sectional view of the single-stage pump casing of FIG. 4.

In some embodiments, each pump stage 16 can include a pump casing 22 that is split into, or manufactured in, two or more pieces, as shown in FIGS. 1, 2, 4, 5A, and 5B. In some embodiments, each piece of the pump casing 22 can be manufactured by a casting process. FIGS. 4 and 5A illustrate exploded views of a single-stage pump casing 22. FIG. 5B illustrates a cross-sectional view of the single-stage pump casing 22. The pump casing 22 can include a front casing 24, a back casing 26, a bladed diffuser 28, and an impeller 30. The diffuser 28 can be static and the impeller 30 can be driven by a rotating shaft 32 that is connected to a shaft of the motor 20. The pump casing 22 can also include a bolt 33, a key 34, a split ring 35, an o-ring 36, a cap 37, wear rings 38, screws 39, and a bearing 40. In some embodiments, the wear rings 38 can be serrated.

The front casing 24 and the back casing 26 can be coupled via fasteners 42, such as bolts, as shown in FIGS. 1 and 2. In some embodiments, the bolts 42 can span across all of the stages 16, connecting all the pump casing 22, as shown in FIG. 1. In other embodiments, multiple bolts 42 can individually connect each pump casing 22, as shown in FIG. 2. For example, as shown in FIGS. 4, 5A, and 5B, the back casing 26 can include through holes 44 and the front casing 24 can include blind holes 46 to receive the bolts 42. In addition, bolts (not shown) can be used to connect additional pump casings 22 at blind holes 50 and through holes 52 of the front casing 24 and back casing 26, respectively. For example, as shown in FIGS. 4 and 5, the back casing 26 can include the through holes 52 and the front casing 24 can include the blind holes 50 to receive the bolts (not shown).

In conventional pumps, pump stages are typically single-piece designs which are manufactured by a casting process. For example, the pump 10 of FIG. 3 includes single-piece pump stages 22. The multi-piece designs of FIGS. 1, 2, 4, 5A, and 5B can have a higher casting quality and can be dimensioned and shaped to enable full access to all internal passages of the pump casing 22. This access enables better surface preparation of the cast pieces, specifically the diffuser 28, the front casing 24, and the back casing 26. Better surface finishes of the cast pieces and the internal passages can greatly reduce frictional losses. Better surface finishes have been found to increase pump efficiency in low specific speed pumps. Also, the multi-piece design allows the pump casings 22 to be split apart and inspected, refinished, and/or cleaned if needed.

In addition, more internal surfaces can be machined in multi-piece designs compared to single-piece designs. In one example, flashing at core parting lines can be eliminated using the multi-piece design because each piece is more accessible, which exposes any flashing and allows it to be easily removed. In some embodiments of the multi-piece design, the diffuser 28, the back cover 26, and the front cover 24 can all be machined. In addition, the diffuser 28, back cover 26, and front cover 24 can all be polished for a better surface finish.

As shown in FIG. 5B, fluid can travel through an eye 54 of the impeller 30 and impeller blades 56 can force the fluid to a collector area 58 at a high velocity. The diffuser 28 can slow down the high velocity fluid and direct it toward the next pumping stage 16, increasing the pressure of the fluid. In some embodiments, the impeller 30 can be designed to reduce or eliminate significant axial flow components (which can reduce pump efficiency), allowing the pumped fluid flow to enter the collector area 58 substantially radially. This can increase efficiency over conventional designs that produce a flow with an inefficient axial component.

In some embodiments, the impeller blades 56 can be angled between about 18 degrees and about 22.5 degrees. These impeller blade angles can enable the pumped fluid to act as a solid body and to access diffuser blades 60 more directly, increasing pump efficiency. Also, diffusion can take place throughout the entire length of each pump stage 16. In addition, the diffuser 28 can have a better surface finish than conventional diffusers (due to the multi-piece design), further increasing the pump efficiency.

The multi-piece design of some embodiments can also enable the use of different sized impellers 30 and diffusers 28, increasing the flexibility of the pump 10 to be used in different applications. For example, the passage height of the collector area 58 can be adjusted by reducing the height of the diffuser blades 60 or inserting a new diffuser 28 with longer blades 60. Adjusting the height of the diffuser blades 60 in the casing portion 22 can enable the pump 10 to have an optimal efficiency for its application by allowing or restricting more or less flow (i.e., achieving a best efficiency point flow rate). This is very difficult or not possible to do in single-piece designs. Also, by being able to more accurately control the diffuser 28 and having a higher efficiency design, the pump 10 can achieve faster speeds using fewer pump stages 16 as compared to conventional pumps. As a result, the pump 10 can be more compact than conventional pumps, while still achieving similar pumping pressures and flow characteristics.

Figure 3:
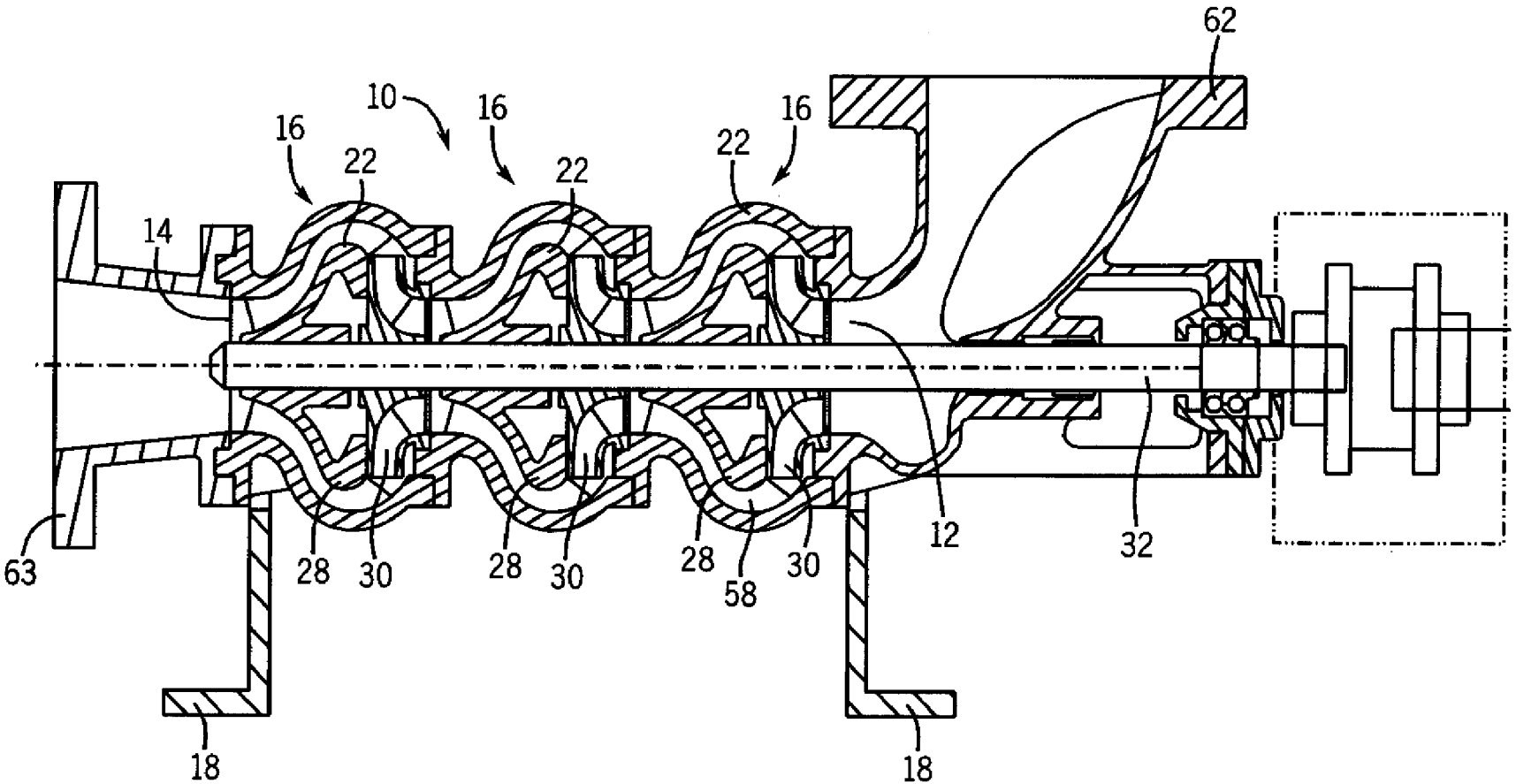
FIG. 3 is a cross-sectional view of a three-stage pump according to yet another embodiment of the invention.

A variety of inlet attachments can be used at the inlet 14. As shown in FIGS. 1 and 3, an inlet attachment 62 including a short-radius elbow such as that produced by Fairbanks Morse under the trademark Turbo-Free™ can be used. The short-radius elbow inlet attachment 62 can also help the pump 10 to achieve higher efficiencies. In some embodiments, the inlet 14 and an inlet attachment 62 can be compliant with the American National Standards Institute/Hydraulics Institute (ANSI/HI) standard 9.8. In addition, a variety of outlet attachments 63 can also be used. The inlet attachments 62 and/or the outlet attachments 63 can be coupled to the front casing 24 or the back casing 26 with fasteners (not shown).

In some embodiments, the pump 10 can also be used with energy recovery devices (not shown) to further increase system efficiency. The pump 10 can be connected to drive turbines, positive displacement pumps, piston-type rotary pumps, etc. In one example, high pressure fluid can be forced into the outlet of the pump 10, allowing the pump to be run backward. The fluid being released from the inlet can have less kinetic energy than the fluid entering the outlet of the pump 10 and energy can be recovered by the fluid generating movement in the pump 10. In addition, one motor 20 can be used for two separate pumps 10, where one pump 10 is used as a feed pump and the other pump 10 is used as a reboost pump.

Figure 6:
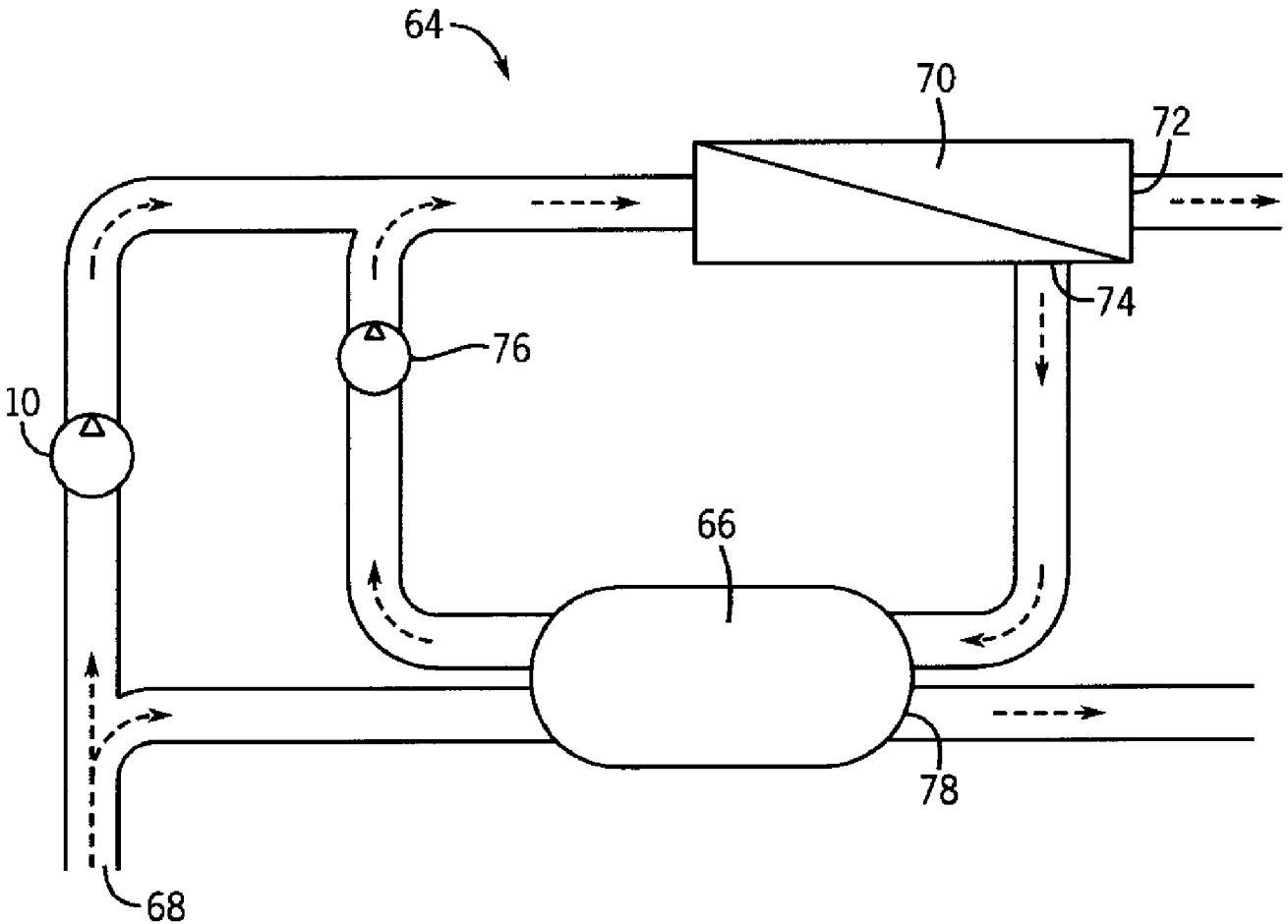
FIG. 6 is a schematic illustration of a sea water reverse osmosis (SWRO) plant using a pump according to one embodiment of the invention.

FIG. 6 illustrates the pump 10 being used in a sea water reverse osmosis (SWRO) plant 64 with an energy recovery device 66. Low pressure sea water enters the plant 64 at entrance 68 and either travels to the pump 10 or the recovery device 66 (e.g., a pressure exchanger). The pump 10 releases high pressure sea water toward a reverse osmosis (RO) membrane 70. The RO membrane 70 releases low pressure fresh water at the plant exit 72. A high-pressure reject stream also leaves the RO membrane 70 at exit 74 and enters the recovery device 66, which is then cycled through back to the RO membrane 70 through a booster pump 76. The low pressure sea water initially directed toward the recovery device 66 can also be released as a low pressure reject stream at exit 78.

Figure 7:
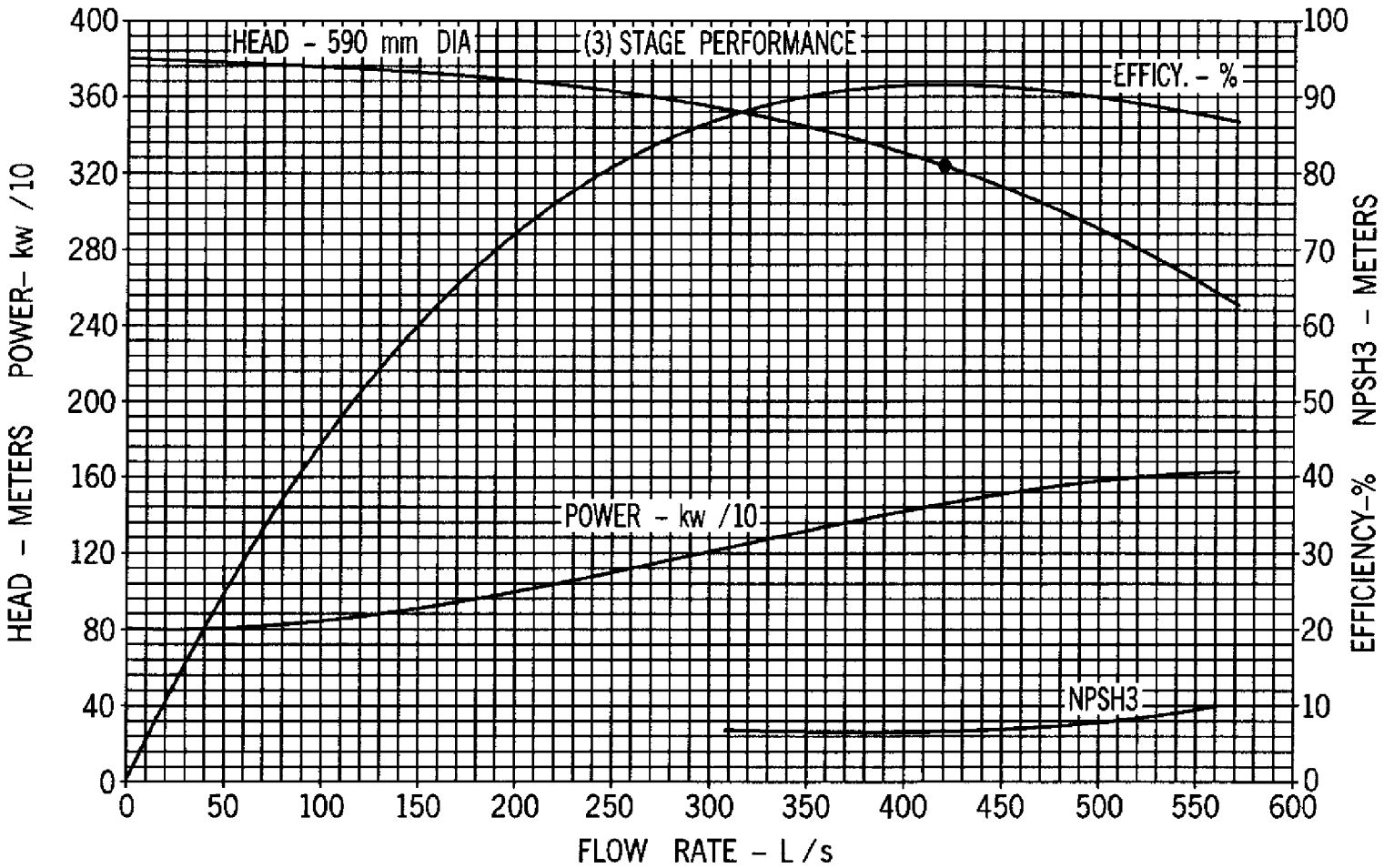
FIG. 7 is a graph illustrating performance of a pump according to one embodiment of the invention.

FIG. 7 is a graph of pump performance for the pump 10 according to one embodiment of the invention. The pump performance shown in FIG. 7 can be for a type 36 RO, vertical orientation pump, with a multi-piece casing design including three pump stages 16. The pump 10 can be manufactured with the following characteristics: rated for about 1489 rotations per minute (RPM), about 711-millimeter diameter at the inlet, about 400-millimeter diameter at the outlet, five-vane impeller with about 590 millimeter diameter, about 0.066-square meter impeller eye, about 51 millimeter sphere, and about 13-vane bowl. As shown in FIG. 7, the pump 10 can reach efficiencies above 90% (e.g., at flow rates around 400 liters per second). In addition, the pump 10 can reach efficiencies ranging from about 86% to about 91% at flow rates between about 300 and about 500 liters per second.

Figure 8C:
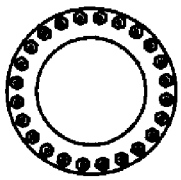
FIGS. 8A-8C are a side view, an end view, and a partial end view of a pump according to one embodiment of the invention.
Figure 8A:
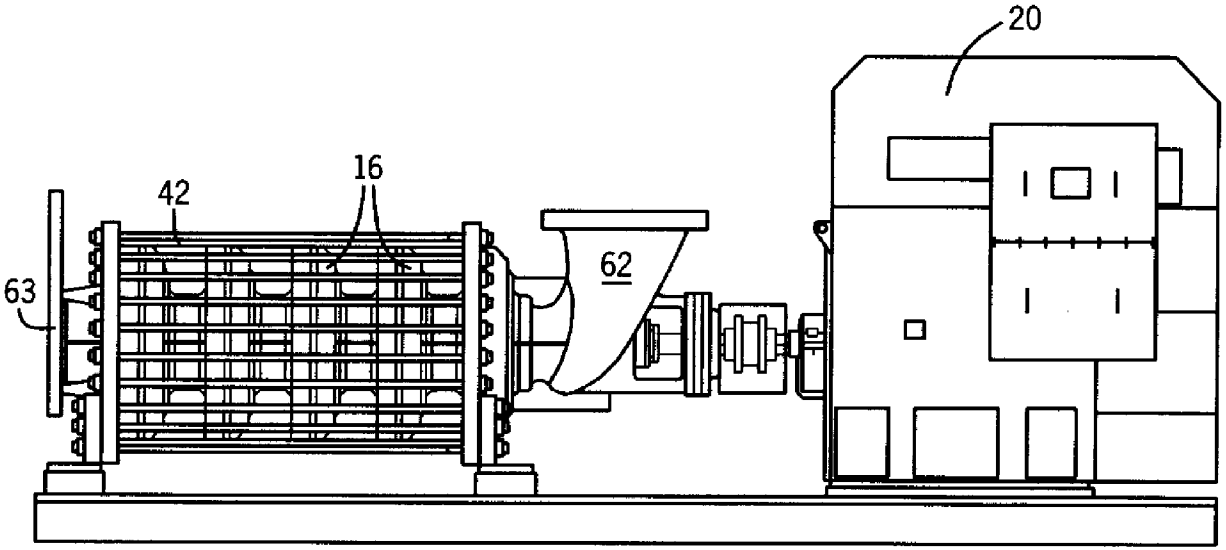
Figure 8B:
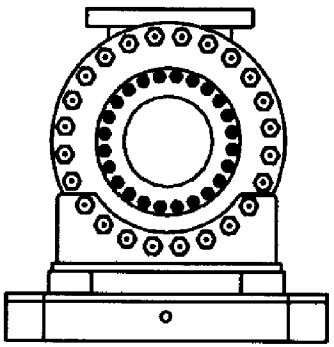
Figure 9:
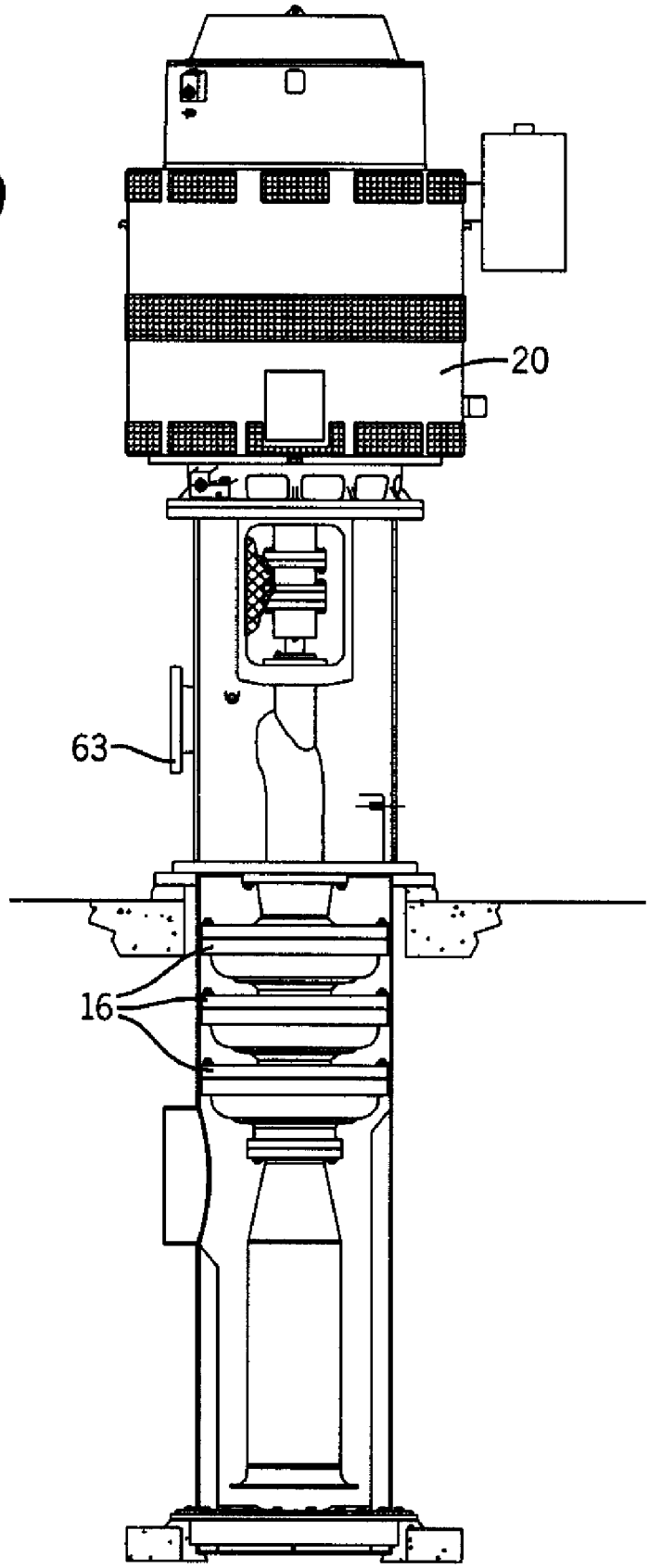
FIG. 9 is a side view of a vertically-mounted pump with dimensions shown for one embodiment of the invention.

FIGS. 8A-8C illustrate dimensions for a 44 inch horizontal pump 10 according to one embodiment of the invention. The pump 10 shown in FIGS. 8A-8C can have a bare pump weight of about 27,500 lbs. The suction nozzle of the pump 10 shown in FIGS. 8A-8C can be rotated in about 15 degree intervals from the position shown. FIG. 9 is a side view of a vertically-mounted pump 10 with dimensions shown for one embodiment of the invention. The dimensions indicated in FIGS. 8A-9 are provided in inches with millimeters in parenthesis. In one embodiment, the pump 10 illustrated in FIG. 9 can be a 36 RO pump driven using a three phase, 2250 horse power motor, with an input voltage of about 6600 volts, alternate current at a frequency of 50 hertz. The pump 10 illustrated in FIG. 9 can rotate at about 1489 rotations per minute achieving a flow rate of about 400 liters per second (6340 gallons per minute) with a total dynamic head of about 298 meters. Nominal discharge pressure of the fluid pumped by the pump 10 illustrated in FIG. 9 can be about 400 pounds per square inch and the pump efficiency can be about 91% on average.

Figure 11:
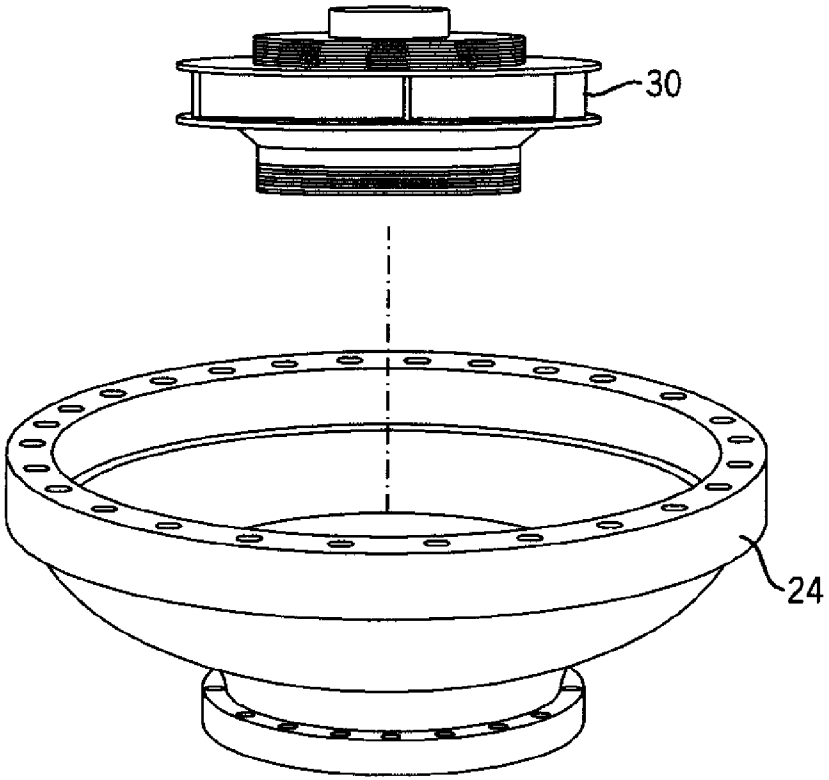
FIG. 11 is a perspective view of the front casing of FIG. 10 and an impeller according to one embodiment of the invention.
Figure 10:
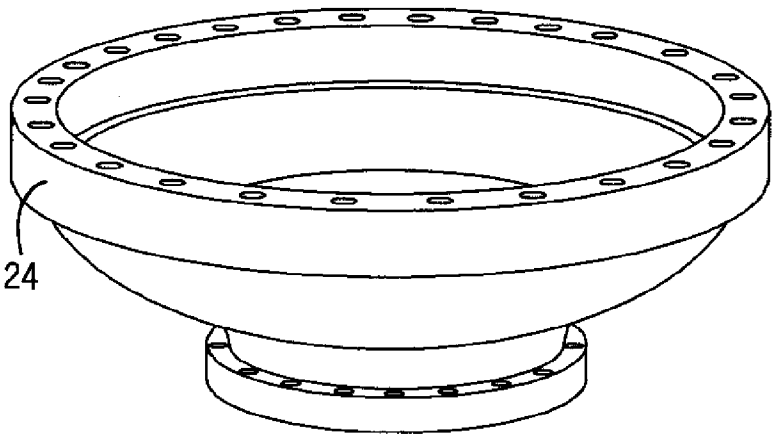
FIG. 10 is a perspective view of a front casing of a pump according to one embodiment of the invention.
Figure 12:
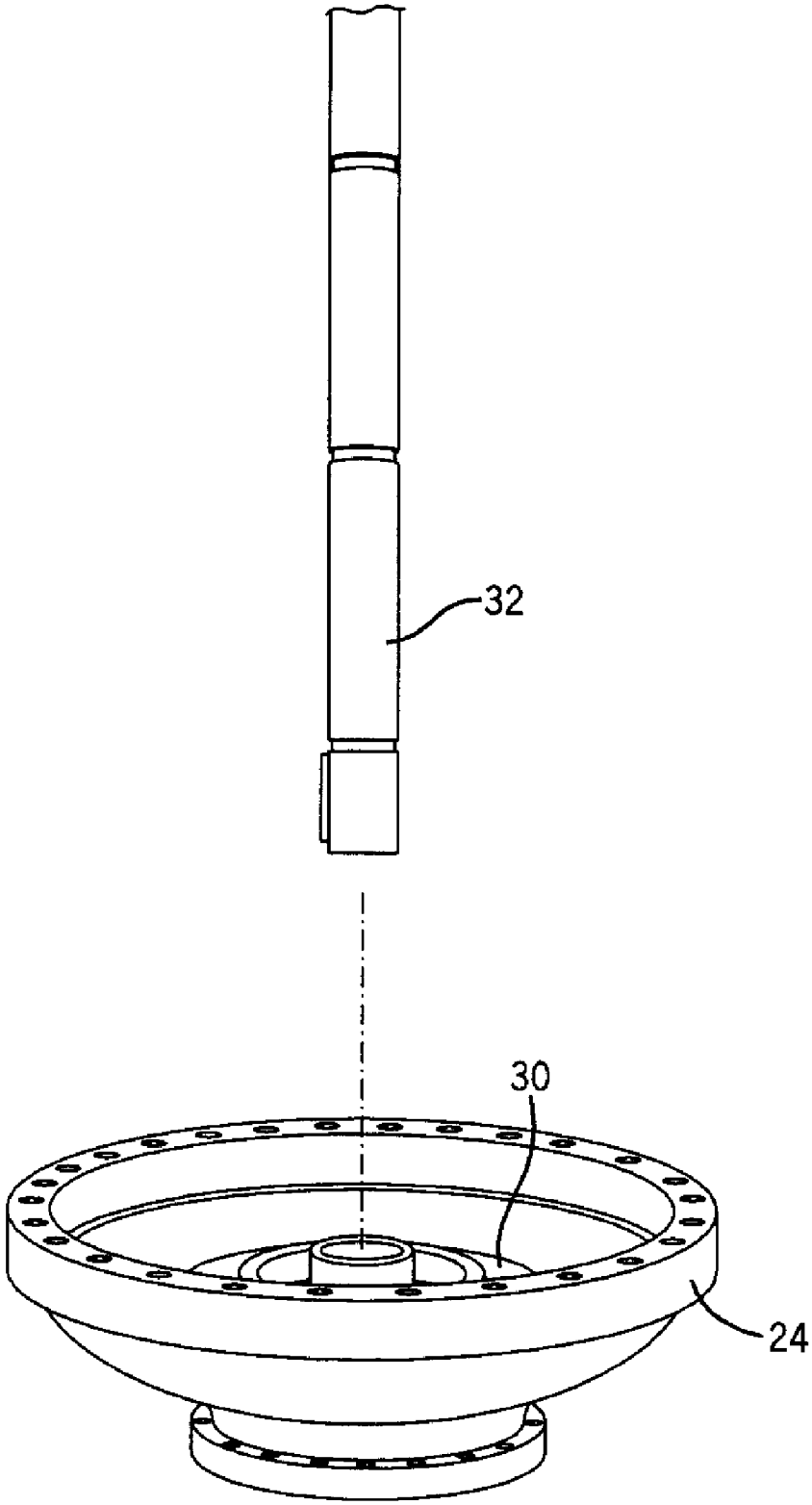
FIG. 12 is a perspective view of the front casing of FIG. 10, the impeller of FIG. 11, and a rotating shaft according to one embodiment of the invention.
Figure 13:
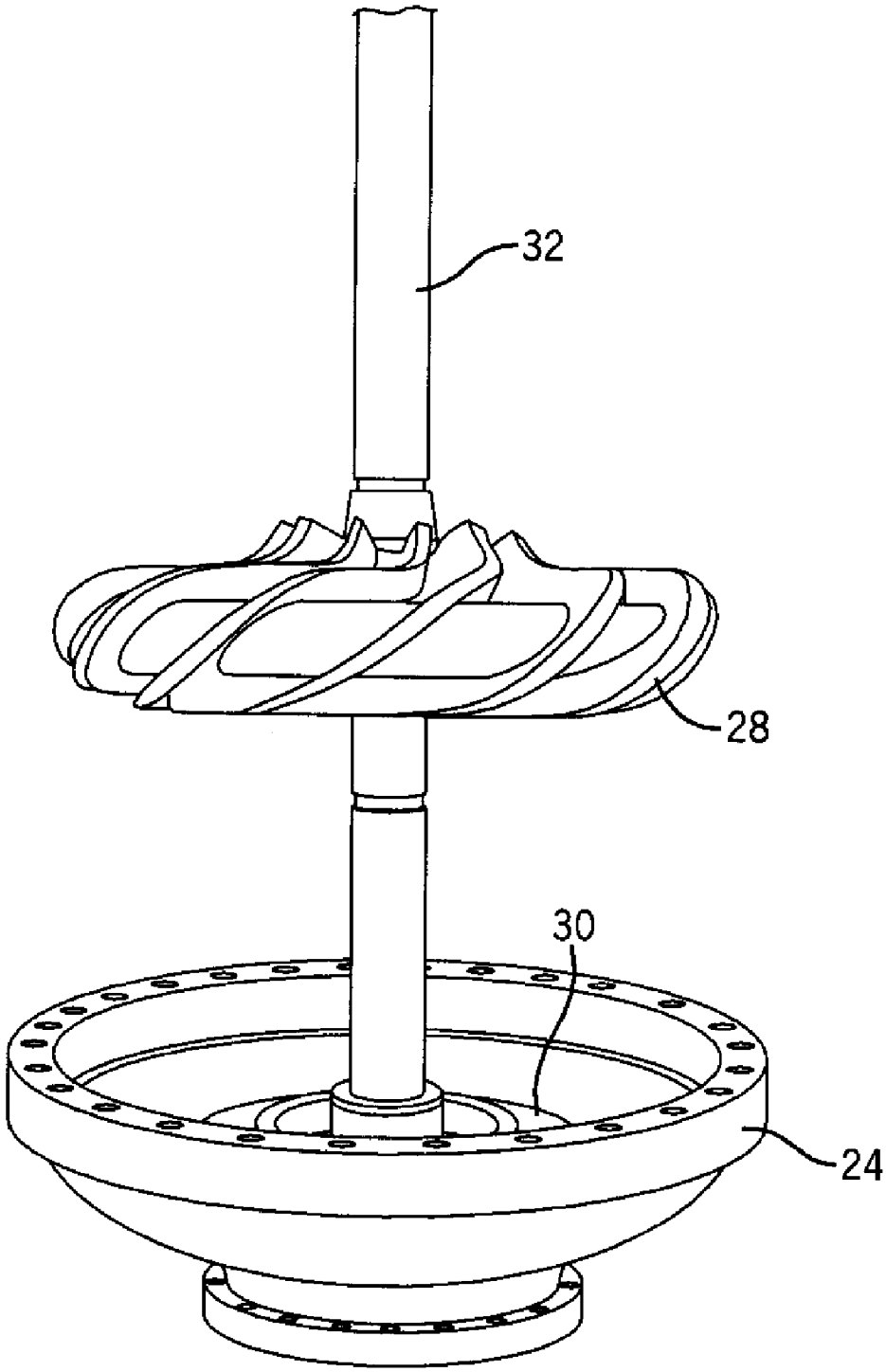
FIG. 13 is a perspective view of the front casing of FIG. 10, the impeller of FIG. 11, the rotating shaft of FIG. 12, and a diffuser according to one embodiment of the invention.
Figure 14:
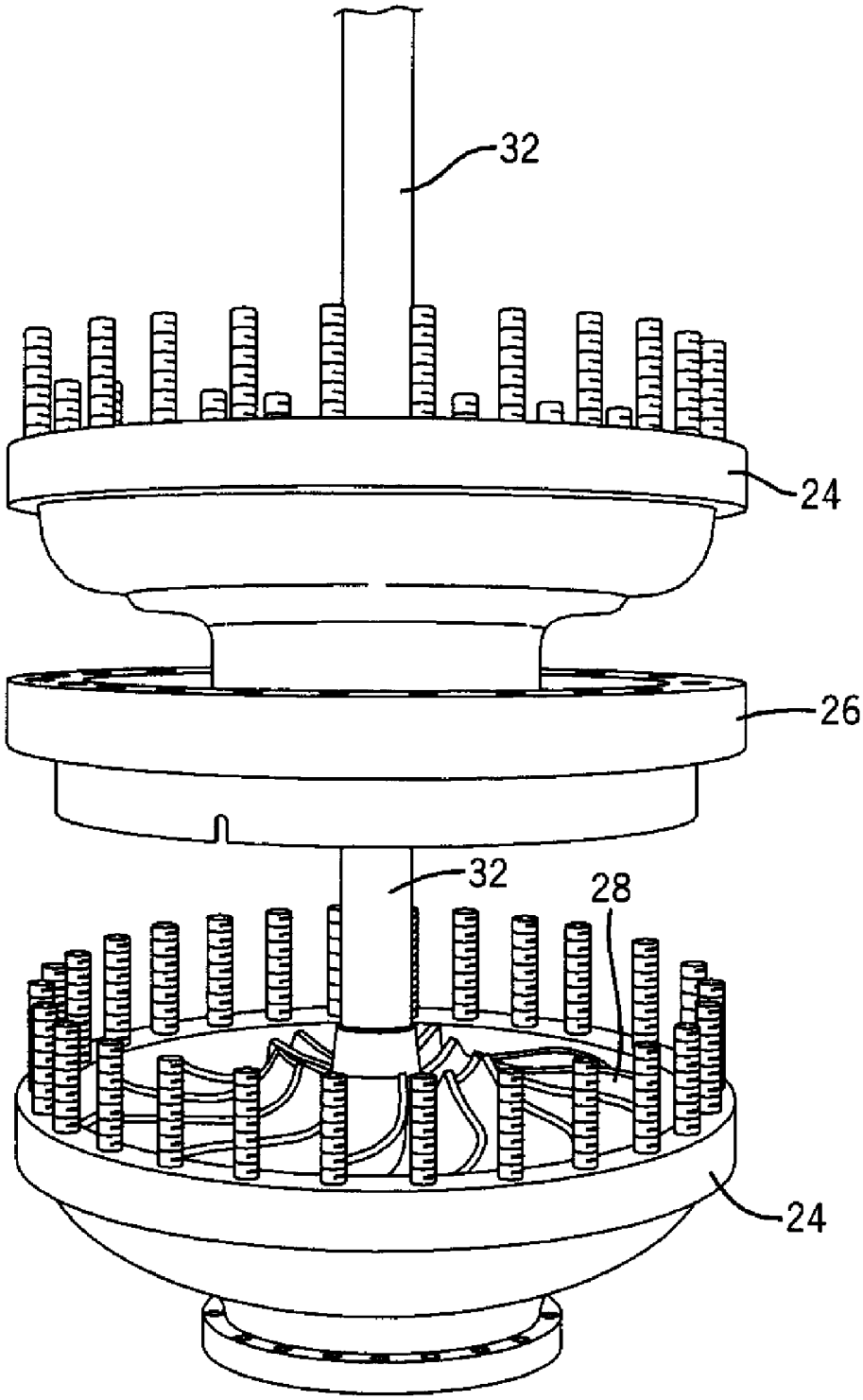
FIG. 14 is a perspective view of first and second front casings, the rotating shaft of FIG. 12, the diffuser of FIG. 13, a back casing, and bolts according to one embodiment of the invention.
Figure 15:
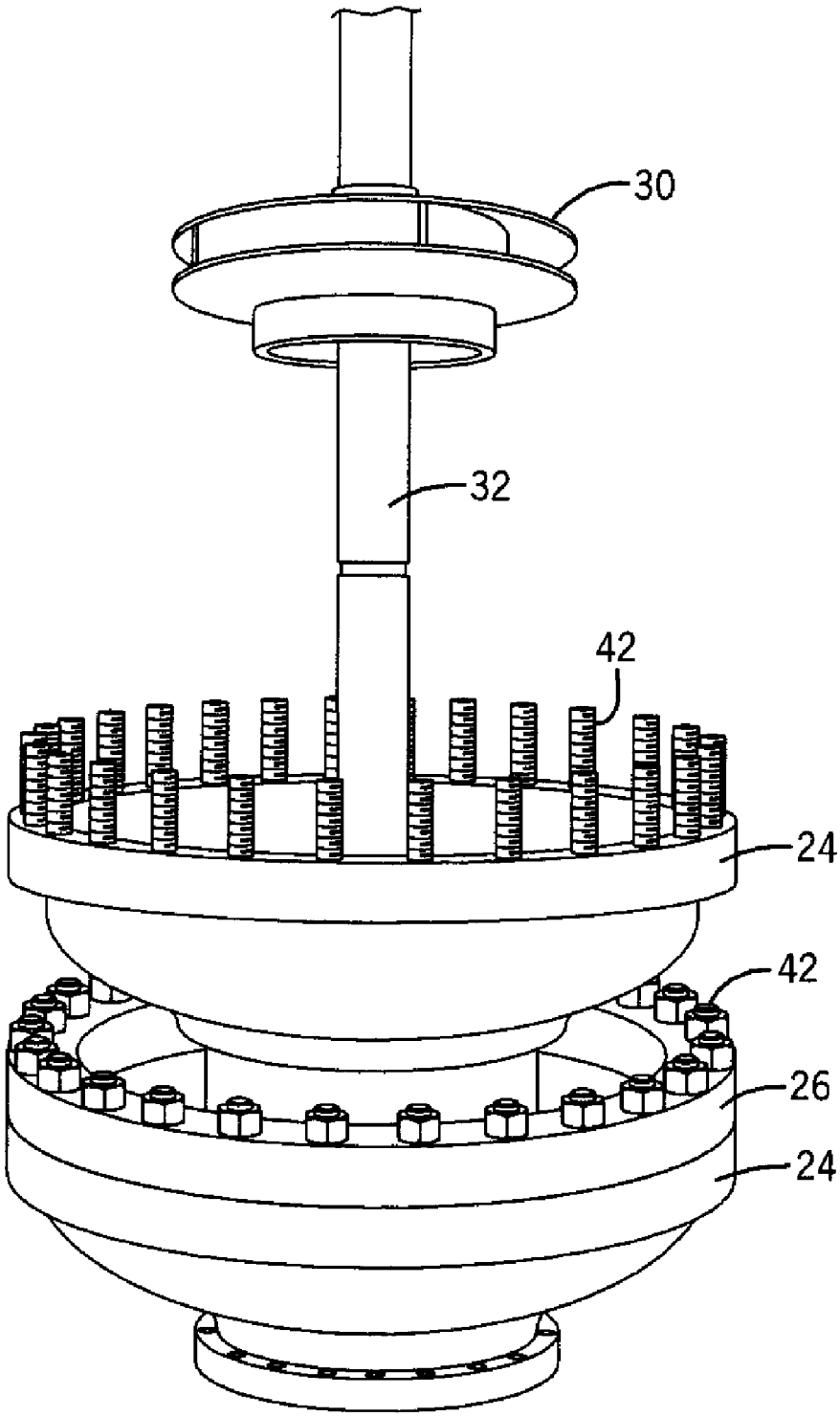
FIG. 15 is a perspective view of the first and second front casings, a second impeller, the rotating shaft of FIG. 12, the back casing of FIG. 14, and bolts according to one embodiment of the invention.
Figure 16:
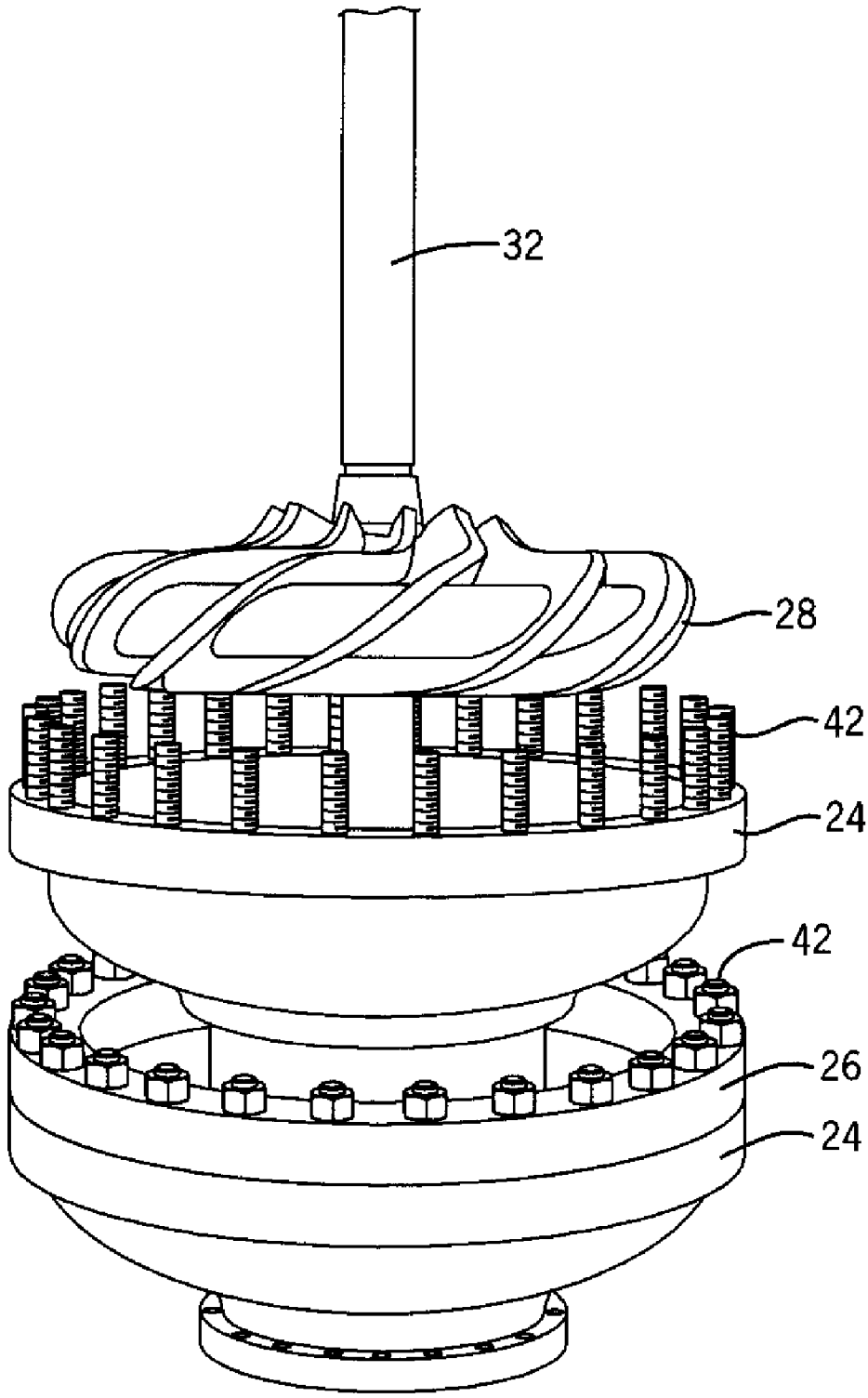
FIG. 16 is a perspective view of the first and second front casings, a second diffuser, the rotating shaft, the back casing, and bolts according to one embodiment of the invention.
Figure 17:
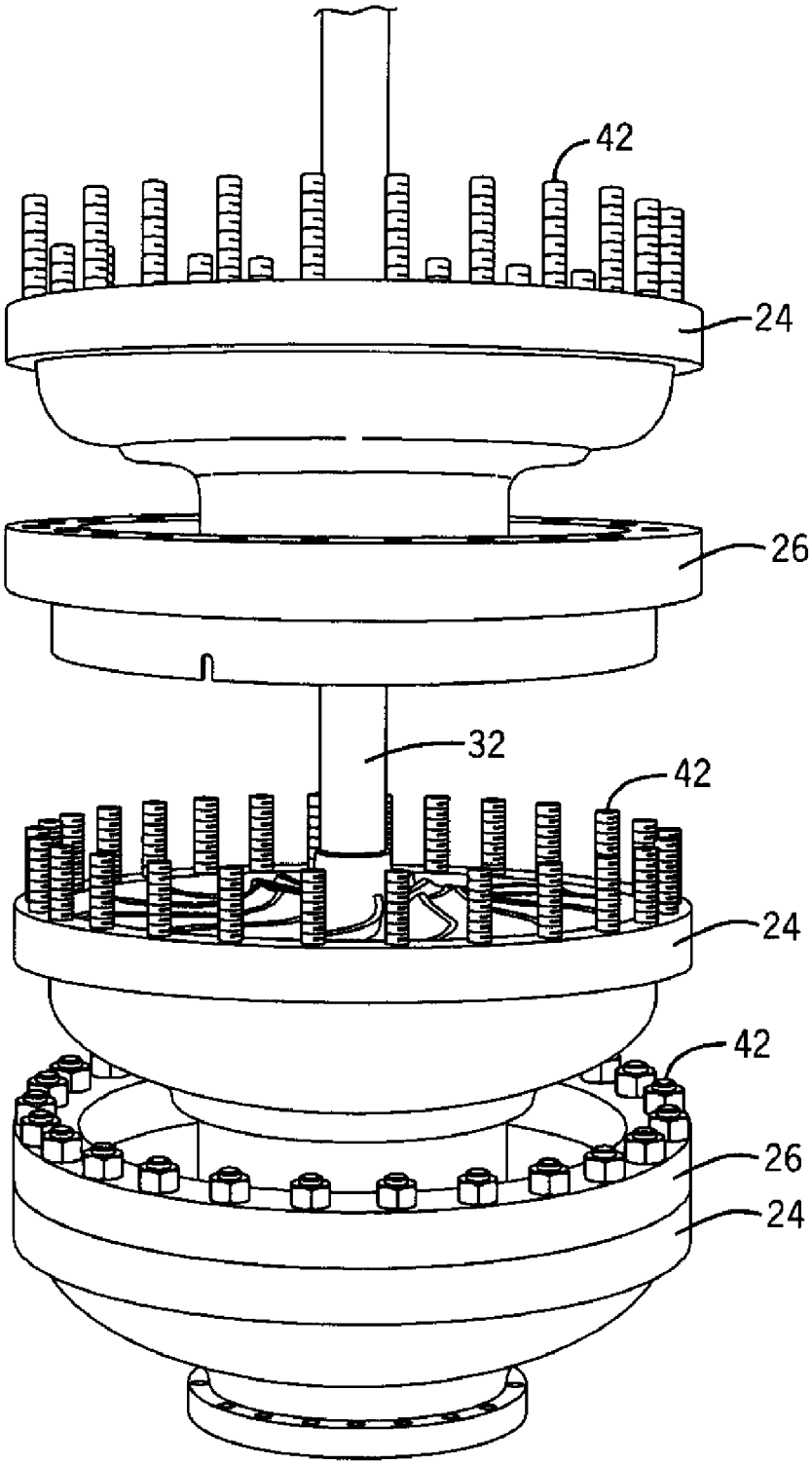
FIG. 17 is a perspective view of first, second, and third front casings; the rotating shaft; first and second back casings; and bolts according to one embodiment of the invention.
Figure 18:
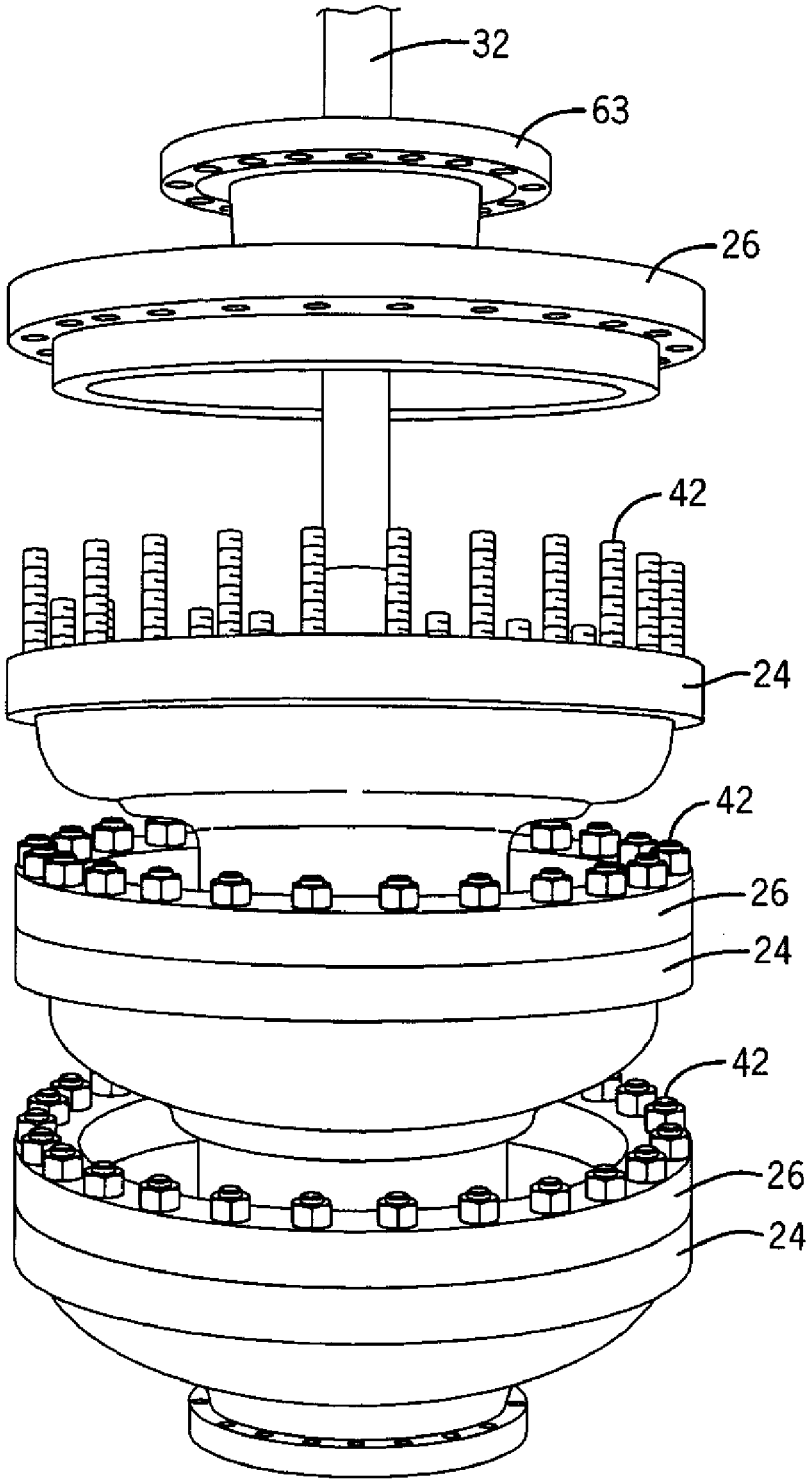
FIG. 18 is a perspective view of first, second, and third front casings; the rotating shaft; first, second, and third back casings; bolts; and an outlet attachment according to one embodiment of the invention.
Figure 19:
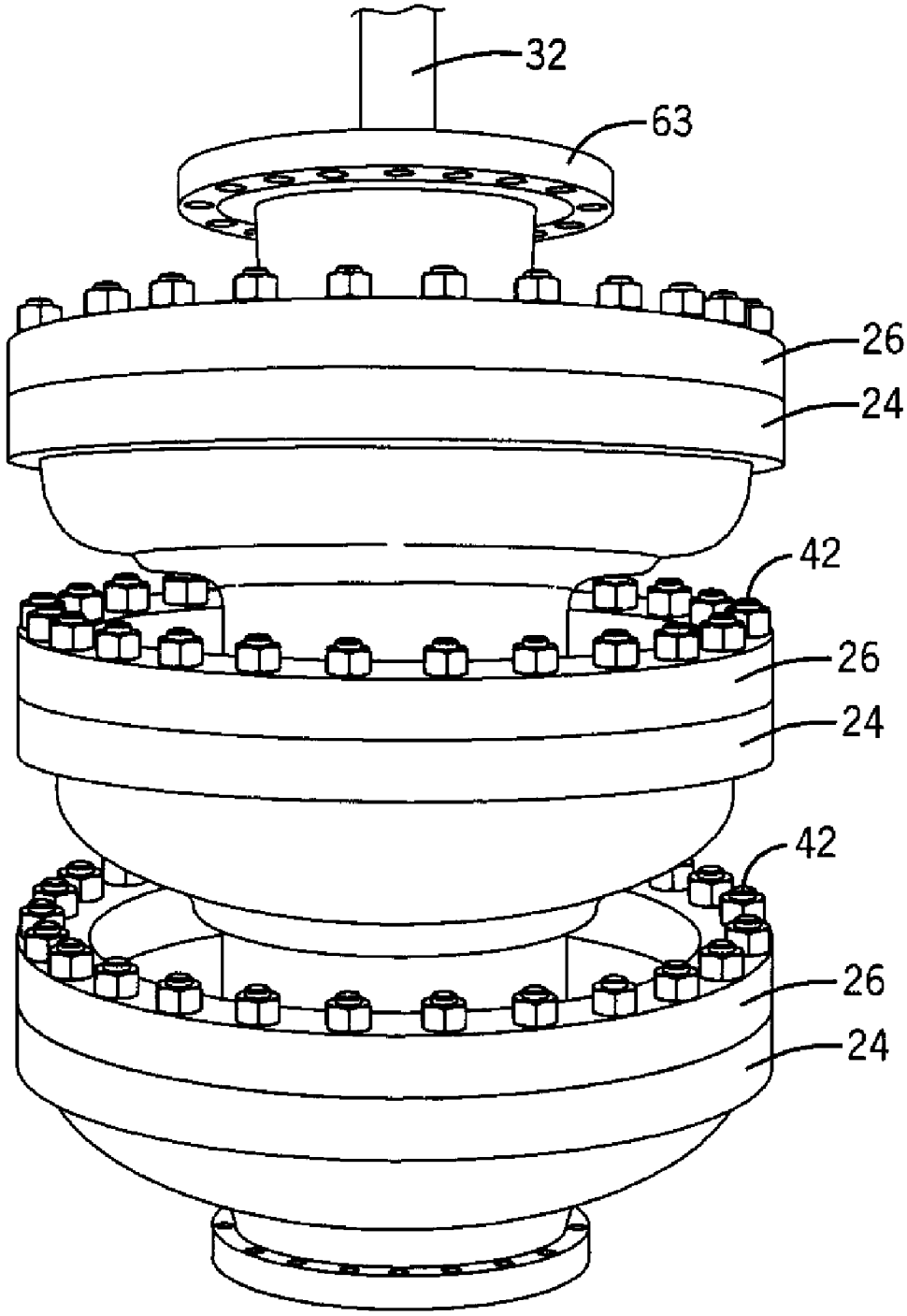
FIG. 19 is a perspective view of three stages of the pump as assembled according to one embodiment of the invention.

FIGS. 10-23 illustrate the stages of an assembly process according to one embodiment of the invention. The front casing 24, the back casing 26, the impeller 30, and the bladed diffuser 28 can each be separately cast and machined before the assembly process. The internal surfaces of the front casing 24, the back casing 26, the impeller 30, and the bladed diffuser 28 can be machined and polished in order to provide the highest efficiency possible for fluid flow. FIG. 10 illustrates the front casing 24 of the pump 10 being prepared for the first stage of assembly. FIG. 11 illustrates the impeller 30 being lowered into the front casing 24. As shown in FIG. 11, the impeller 30 can include thrust balance holes. The thrust balance holes can allow individual thrust balancing in each stage 16, removing the need for balance drums or balance disks. FIG. 12 illustrates the impeller 30 installed in the front casing 24 and the shaft 32 being lowered into the impeller 30. FIG. 13 illustrates the front casing 24, the impeller 30, the shaft 32, and the diffuser 28 being lowered into the front casing 24. FIG. 14 illustrates first and second front casings 24, the shaft 32, the diffuser 28 in position inside the first front casing 24, and the back casing 26. FIG. 15 illustrates the first stage assembled and the second stage being assembled by positioning the second impeller 30. FIG. 16 illustrates the second stage being assembled by positioning the second diffuser 28. FIG. 17 illustrates the continued assembly of the second stage by positioning the second back casing 26 and the beginning of the assembly of the third stage by positioning the third front casing 24. FIG. 18 illustrates the continued assembly of the third stage by positioning the third back casing 26 and one portion of the outlet attachment 63 (i.e., a discharge head). FIG. 19 illustrates the assembled three-stage pump 10 before being coupled to the motor 20. At this point in the assembly process, the shaft 32 can be checked for straightness.

Figure 20:
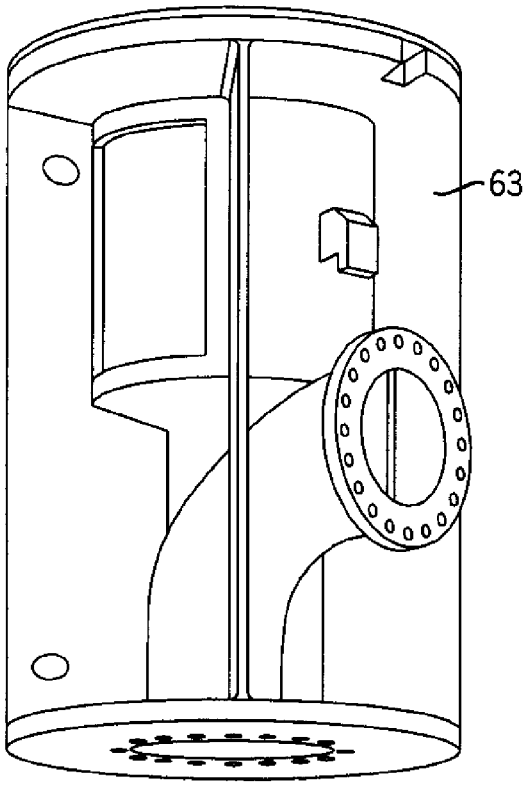
FIG. 20 is a perspective view of an outlet attachment or discharge head according to one embodiment of the invention.
Figure 21:
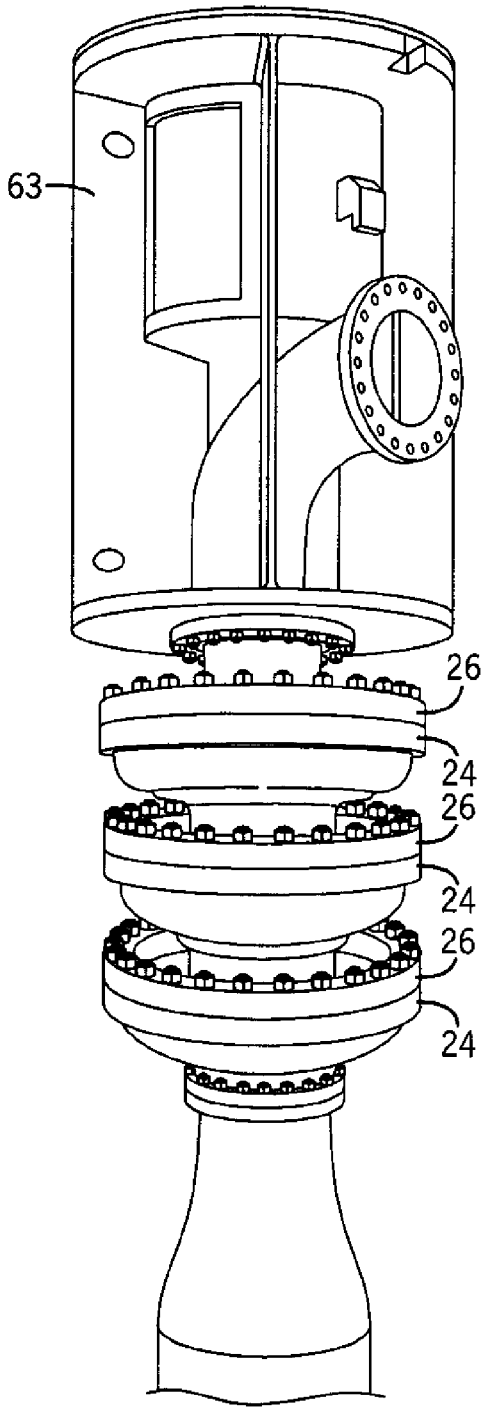
FIG. 21 is a perspective view of the discharge head of FIG. 20 coupled to the three stage pump of FIG. 19 according to one embodiment of the invention.
Figure 23:
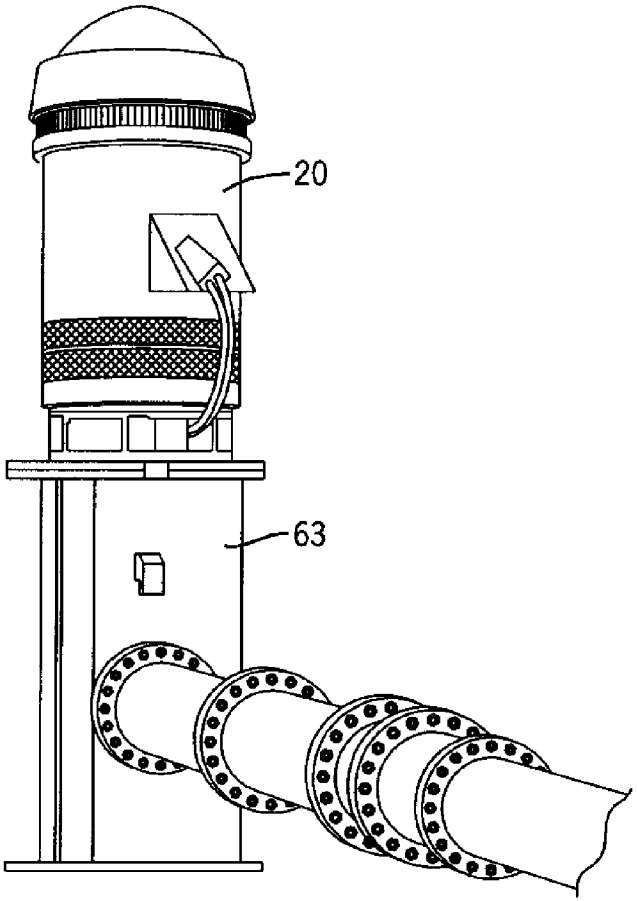
FIG. 23 is a perspective view of the motor of FIG. 22 and the discharge head of FIG. 20 coupled to a pipe according to one embodiment of the invention.
Figure 22:
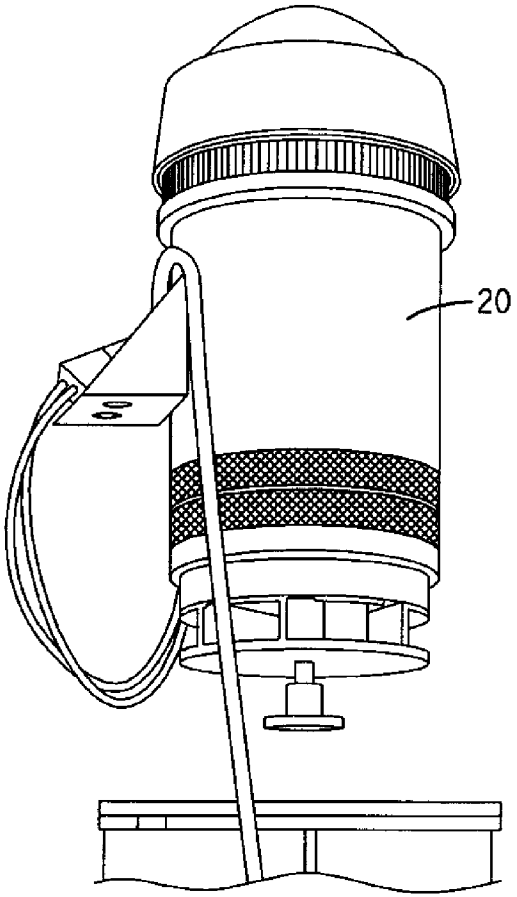
FIG. 22 is a perspective view of a motor for use with the three stage pump of FIG. 19 and the discharge head of FIG. 20 according to one embodiment of the invention.

FIG. 20 illustrates another portion of the discharge head 63 according to one embodiment of the invention. FIG. 21 illustrates the discharge head 63 coupled to the three-stage pump 10 and a section pipe. FIG. 22 illustrates a motor 20 for use with the three-stage pump 10. FIG. 23 illustrates the motor 20 coupled to discharge head 63 and an output pipe.

Figure 25:
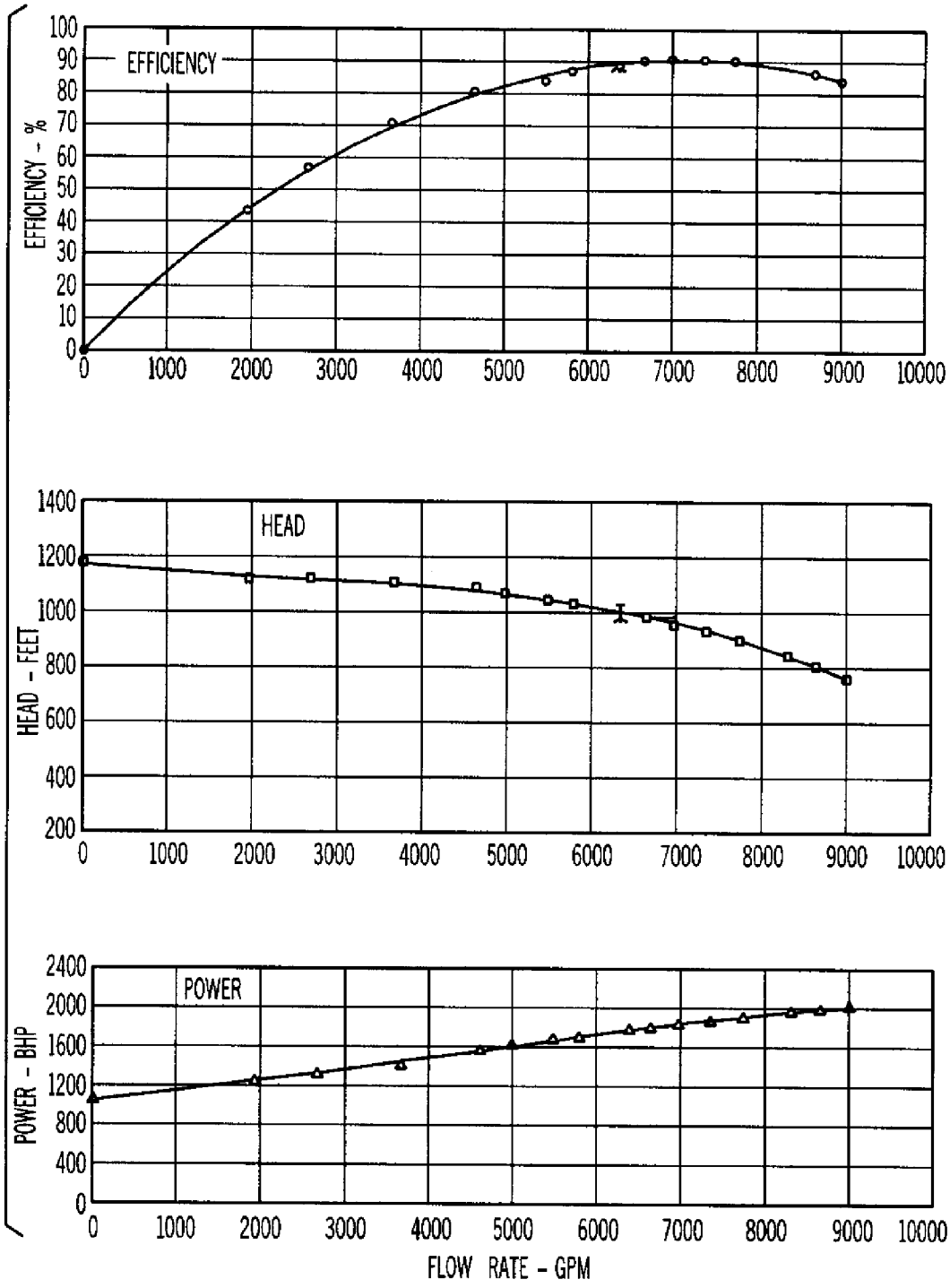
FIG. 25 includes three graphs of test data for one embodiment of the pump.
Figure 26:
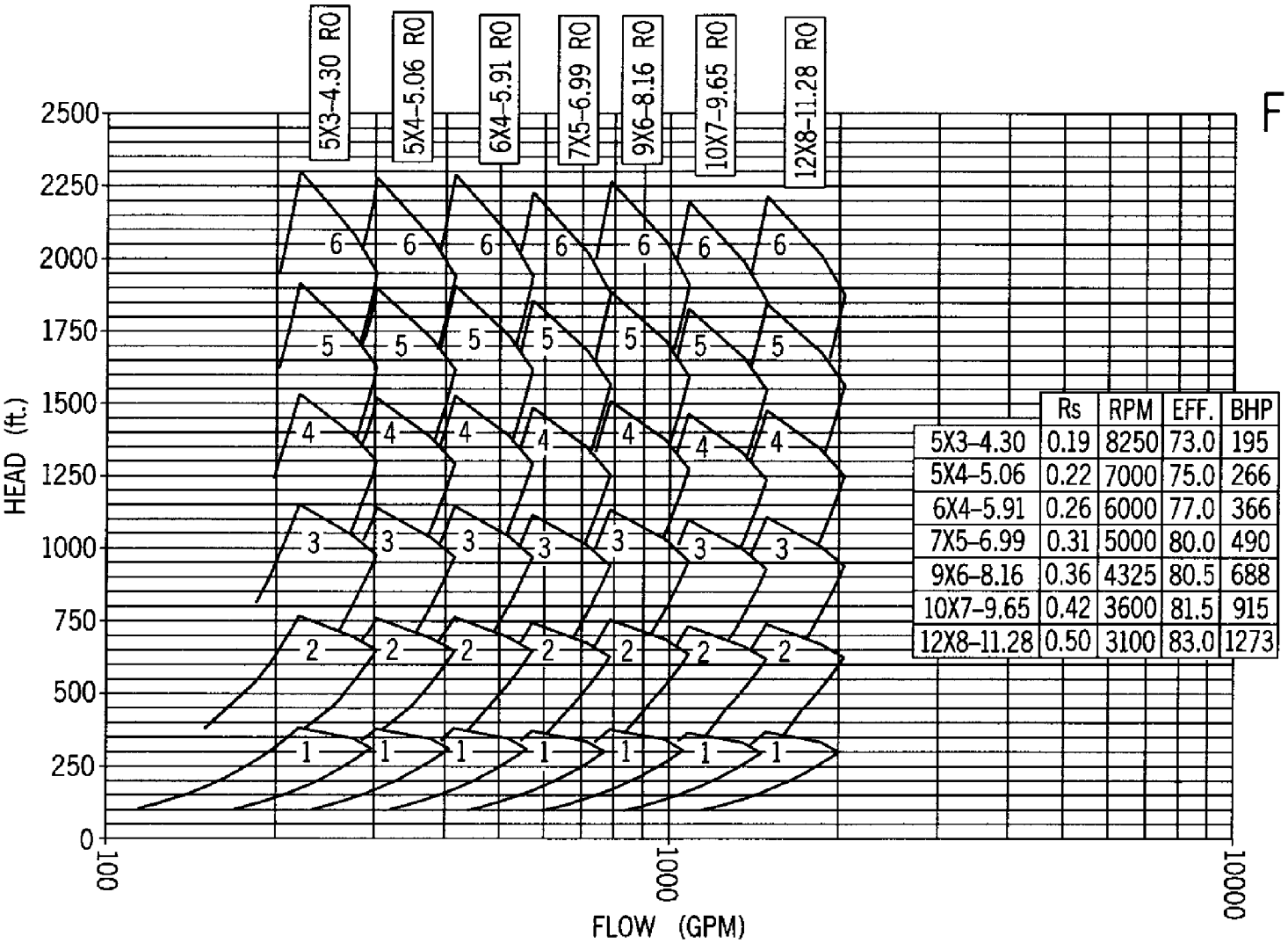
FIG. 26 is a range chart for small SWRO pumps according to some embodiments of the invention.

FIG. 24 is a table of test data for one embodiment of the pump 10. FIG. 25 includes three graphs of test data for one embodiment of the pump 10. FIG. 26 is a range chart for small SWRO pumps.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A high-efficiency, multi-stage pump for pumping a fluid and being driven by a motor, the multi-stage pump comprising:

three pump stages, each one of the three pump stages including a front casing, a back casing, an impeller, and a bladed diffuser, the impeller at least partially encircling the bladed diffuser;

the front casing and the back casing being removably coupled around the impeller and the bladed diffuser to allow access to polish substantially entire inner surfaces of the front casing and the back casing when the front casing and the back casing are uncoupled from each other;

the fluid being pumped through the three pump stages at a flow rate between about 300 liters per second and about 500 liters per second with an efficiency between about 86% and about 91% due at least in part to polishing substantially entire inner surfaces of the front casing and the back casing.

2. The multi-stage pump of claim 1 and further comprising an inlet and an outlet, and wherein the motor is driving the multi-stage pump at the inlet.

3. The multi-stage pump of claim 2 and further comprising a short-radius elbow attached to the inlet.

4. The multi-stage pump of claim 1 wherein the impeller includes an impeller eye which receives the fluid and impeller blades that release the fluid substantially radially outward; and wherein the bladed diffuser includes diffuser blades that direct the fluid toward one of the three pump stages.

5. The multi-stage pump of claim 4 wherein the impeller blades are angled between about 18 degrees and about 22.5 degrees.

6. The multi-stage pump of claim 1 wherein the front casing, the back casing, the impeller, and the bladed diffuser are made of stainless steel.

7. The multi-stage pump of claim 1 wherein the front casing, the back casing, the impeller, and the bladed diffuser are manufactured by a casting process.

8. A method for assembling a stage of a multi-stage pump, the method comprising:

separately casting a front casing, a back casing, an impeller, and a bladed diffuser;

machining the front casing, back casing, the impeller, and the bladed diffuser;

polishing an entire first inner surface of the front casing, polishing an entire second inner surface of the back casing, polishing an entire surface of the impeller, and polishing the bladed diffuser, each of the entire first inner surface of the front casing, the entire second inner surface of the back casing, and the entire surface of the impeller defining an internal passage for fluid flow through the stage when the stage is assembled; and removably coupling the front casing and the back casing together around the impeller and the bladed diffuser.

* * * * *